US009890519B2

(12) United States Patent
Weyer

(10) Patent No.: US 9,890,519 B2
(45) Date of Patent: Feb. 13, 2018

(54) TILTABLE TOOL ASSEMBLY

(71) Applicant: 1994 Weyer Family Limited Partnership, Enumclaw, WA (US)

(72) Inventor: Dean R. Weyer, Enumclaw, WA (US)

(73) Assignee: Helac Corporation, Enumclaw, WA (US)

( * ) Notice: Subject to any disclaimer, the term of this patent is extended or adjusted under 35 U.S.C. 154(b) by 1154 days.

(21) Appl. No.: 14/032,546

(22) Filed: Sep. 20, 2013

(65) Prior Publication Data

US 2014/0020917 A1 Jan. 23, 2014

Related U.S. Application Data

(63) Continuation of application No. 12/954,455, filed on Nov. 24, 2010, now Pat. No. 8,544,562.

(60) Provisional application No. 61/264,565, filed on Nov. 25, 2009.

(51) Int. Cl.

| | |
|---|---|
| ***E02F 3/36*** | (2006.01) |
| ***E02F 3/39*** | (2006.01) |
| ***E02F 9/22*** | (2006.01) |
| ***F15B 15/06*** | (2006.01) |

(52) U.S. Cl.

CPC ..... *E02F 9/2271* (2013.01); *E02F 3/3663* (2013.01); *E02F 3/3677* (2013.01); *E02F 3/3681* (2013.01); *F15B 15/068* (2013.01)

(58) Field of Classification Search

CPC ..... E02F 3/3663; E02F 3/3677; E02F 9/2271; F15B 15/149

USPC ..... 92/111, 163; 173/218

See application file for complete search history.

(56) References Cited

U.S. PATENT DOCUMENTS

| | | | | | |
|---|---|---|---|---|---|
| 3,104,592 | A | | 9/1963 | Sheesley | |
| 3,413,029 | A | | 11/1968 | Donovan | |
| 3,896,950 | A | * | 7/1975 | McCain | E02F 3/3677 37/461 |
| 4,134,329 | A | | 1/1979 | Belliere | |
| 4,422,366 | A | * | 12/1983 | Weyer | F15B 15/224 91/26 |
| 4,881,419 | A | | 11/1989 | Weyer | |
| 4,881,867 | A | * | 11/1989 | Essex | E02F 3/3622 294/103.1 |
| 4,906,161 | A | * | 3/1990 | Weyer | E02F 3/345 37/403 |
| 4,987,825 | A | * | 1/1991 | Weyer | F15B 15/063 92/2 |
| 5,082,389 | A | * | 1/1992 | Balemi | E02F 3/3622 37/468 |
| 5,145,313 | A | * | 9/1992 | Weyer | E02F 3/3618 37/468 |

(Continued)

*Primary Examiner* — Thanh Truong
*Assistant Examiner* — Patrick Fry
(74) *Attorney, Agent, or Firm* — George C. Rondeau, Jr.; Davis Wright Tremaine LLP

(57) ABSTRACT

A fluid-powered tool actuator usable with a vehicle having an arm and a rotation link for rotation of the tool actuator in a first plane and being laterally tiltable in a second transverse plane. In some embodiments pressurized fluid is communicated using distribution channels and passageways internal to the actuator to limit use of external hydraulic lines. In some embodiments the tool actuator has certain components in a compressive pre-loaded state to reduce their fatigue failure during operation of the tool actuator under load.

34 Claims, 28 Drawing Sheets

(56) References Cited

U.S. PATENT DOCUMENTS

| | | | | | |
|---|---|---|---|---|---|
| 5,242,258 | A * | 9/1993 | Weyer | E02F 3/3618 | 37/468 |
| 5,267,504 | A * | 12/1993 | Weyer | E02F 3/3677 | 92/31 |
| 5,309,816 | A | 5/1994 | Weyer | | |
| 5,327,812 | A | 7/1994 | Weyer | | |
| 5,692,325 | A * | 12/1997 | Kuzutani | E02F 3/3618 | 37/406 |
| 6,146,082 | A * | 11/2000 | York | E02F 3/3622 | 414/695.5 |
| 6,379,075 | B1 * | 4/2002 | Shamblin | E02F 3/3613 | 37/468 |
| 6,578,296 | B2 * | 6/2003 | Kimoto | E02F 9/2267 | 37/443 |
| 6,964,122 | B2 * | 11/2005 | Cunningham | E02F 3/3618 | 37/468 |
| 8,192,561 | B2 * | 6/2012 | Larker | C21D 5/00 | 148/321 |
| 2006/0230649 | A1 * | 10/2006 | Gusella | B66C 3/16 | 37/444 |

* cited by examiner

TILTABLE TOOL ASSEMBLY

BACKGROUND OF THE INVENTION

Field of the Invention

The present invention relates generally to backhoes and excavators and, more particularly, to buckets and other tools which are laterally tiltable.

Description of the Related Art

Backhoes, excavators and similar type vehicles have an extendable or articulated arm with a tool such as a bucket attached at an end thereof remote from the operator. Generally, a rotation link is associated with the arm. The bucket is pivotally attached to the arm by a clevis which serves as a pivot point for the bucket. The rotation link is also pivotally attached to the bucket so that movement of the rotation link causes the bucket to rotate about the arm pivot point. With such an arrangement, the bucket can be rotated relative to the arm in a generally vertical, forwardly extending plane defined by the arm and the rotation link, but lateral tilting of the bucket is not possible, at least without tilting of the vehicle. The arm and rotation link are usually not laterally tiltable relative to the vehicle to which they are attached.

There are occasions, however, when it would be very desirable to work with the bucket tilted to the left or right, such as when necessary to adjust for slope requirements or to do side-angle grading. It is, of course, undesirable and often not possible to laterally tilt the entire vehicle to achieve tilting of the bucket. This problem has been overcome with the advent of laterally tiltable buckets. Such buckets generally include a hinge adaptor which is attached to the arm and the rotation link, much in the same way buckets were directly attached in the past. The adaptor serves as a hinge and pivotally supports a bucket for lateral rotation of the bucket about a hinge axis which is generally aligned with the forward rotation plane through which the bucket is conventionally rotated. This allows the bucket to be laterally tilted from side to side. Control of the amount of lateral tilting is accomplished using a double-acting cylinder which extends laterally between the hinge adaptor and the bucket to selectively cause the bucket to rotate about the hinge axis. Extension of the double-acting cylinder causes the bucket to rotate to one side, and retraction of the cylinder causes it to rotate to the other side.

To achieve the desirable range of tilting, such an arrangement has required a relatively long, double-acting cylinder. As such, only relatively wide buckets could accommodate the amount of extension and retraction of the double-acting cylinder required to laterally tilt the bucket to the extent desired. The more tilting required, the greater the space required to handle the double-acting cylinder to be used, because greater extension is needed. Of course, space limitations not only limit the length of the double-acting cylinder which can be used, but also the torque output achievable with the cylinder. The use of a bucket that is wide enough to accommodate the elongated double-acting cylinders does not always solve these problems, because certain type jobs can best be done only with relatively narrow buckets. Typically, it is desired to have tiltable buckets tilt 45 degrees to the left and to the right relative to the vertical.

The need for a laterally tiltable bucket assembly which uses a relatively narrow width bucket has been largely met by the Tiltable Bucket Assembly described in U.S. Pat. No. 4,906,161. That bucket assembly can transmit large torque to the bucket and firmly hold the bucket at the desired tilt angle. That bucket assembly does not, however, provide means for quickly disconnecting the bucket or other tool from the vehicle arm and rotation link, but rather requires the operator to remove the pins which hold the bucket in place and re-insert them for the next tool to be attached. This is a slow and sometimes difficult process.

One solution to the need for a quick disconnect of a bucket or other tool from the vehicle arm and rotation link was provided by U.S. Pat. No. 5,145,313 and U.S. Pat. No. 5,242,258. However, there has been determined to exist a need for a stronger, lighter and more versatile design.

It will, therefore, be appreciated that there has been a significant need for a laterally tiltable tool assembly which can quickly and easily disconnect and re-connect the bucket or another tool, and will provides improvements over prior art assemblies. The present invention fulfills this need and further provides other related advantages.

BRIEF DESCRIPTION OF THE SEVERAL VIEWS OF THE DRAWING(S)

DETAILED DESCRIPTION OF THE INVENTION

Figure 1:
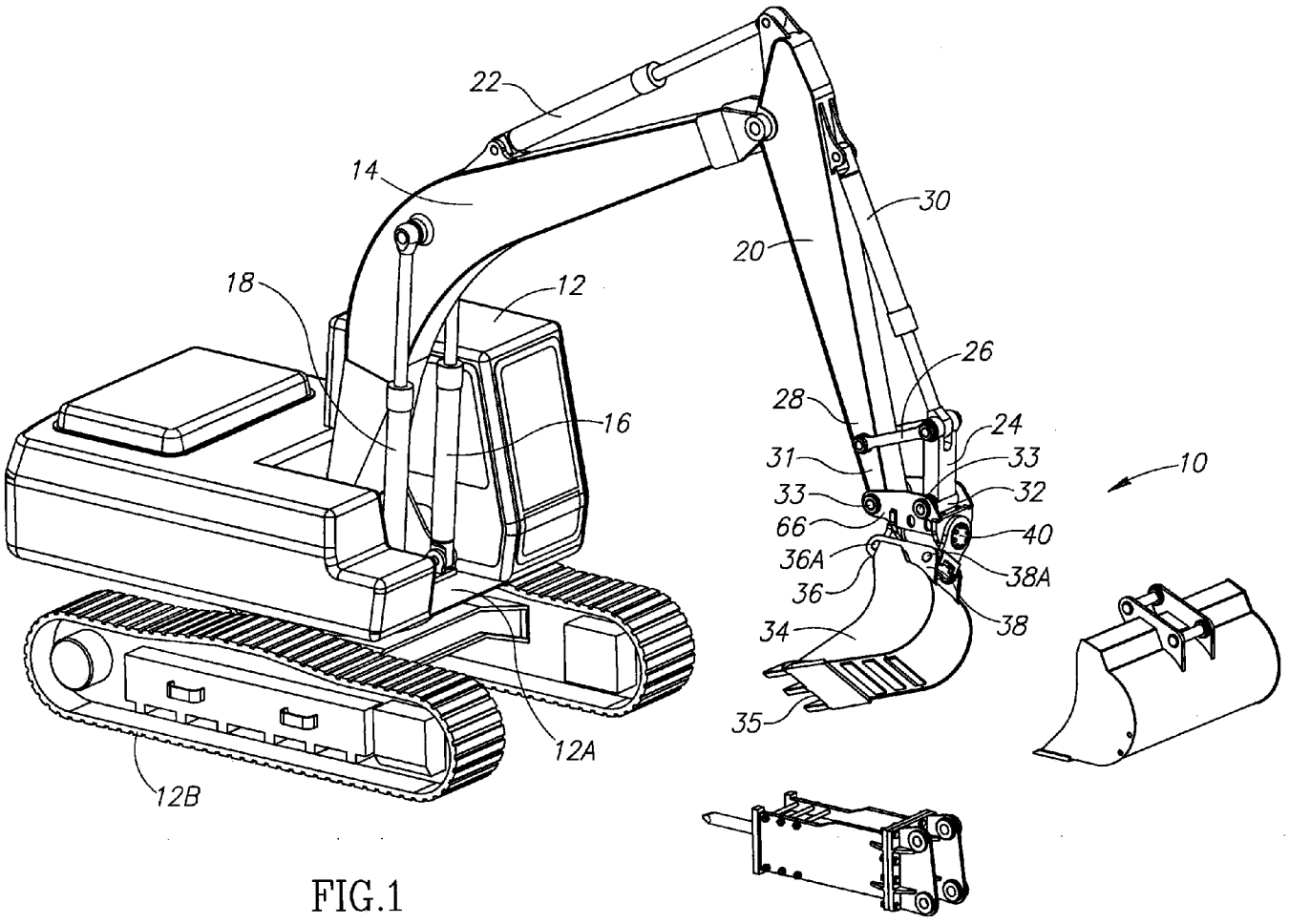
FIG. 1 is a front right side perspective view of an excavator shown with one version of a laterally tiltable tool assembly embodying the present invention with a bucket attached and showing other attachable tools on the ground.

As shown in the drawings for purposes of illustration, the present invention is embodied in a fluid-powered, laterally tiltable tool assembly, indicated generally by reference numeral 10. As shown in FIG. 1, the tool assembly is usable with a vehicle 12, such as the illustrated excavator or any other suitable type vehicle such as a backhoe that might use a bucket or other tool as a work implement. The vehicle 12 has a first arm 14 which is pivotally connected by one end to a base member (not shown) forming a part of the platform 12A of the vehicle. A pair of hydraulic cylinders 16 and 18 are provided for raising and lowering the first arm in a generally forwardly extending vertical plane with respect to the base member. A second arm 20 is pivotally connected by one end to an end of the first arm 14 remote from the base member. A hydraulic cylinder 22 is provided for rotation of the second arm 20 relative to the first arm 14 in the same vertical forward rotation plane as the first arm operates.

The platform 12A of the vehicle 12 is pivotally mounted and supported by a track drive undercarriage 12B and is pivotally movable about a vertical axis so as to permit movement of the first and second arms 14 and 20 in unison to the left or right, with the first and second arms always being maintained in the forward rotation plane. It is noted that while the forward rotation plane is referred to as being forwardly extending for convenience of description, as the platform 12A is pivoted relative to the track drive, the forward rotation plane turns about the vertical pivot axis of the track drive and thus to a certain extent loses its forward-to-rearward orientation, with the plane actually extending laterally relative to the undercarriage 12B should the platform be sufficiently rotated.

A rotation link 24 is pivotally connected through a pair of interconnecting links 26 to an end portion 28 of the second arm 20 remote from the point of attachment of the second arm to the first arm 14. A hydraulic cylinder 30 is provided for selective movement of the rotation link 24 relative to the second arm 20.

As is conventional, a free end portion 31 of the second arm 20 and a free end portion 32 of the rotation link 24 each has a transverse aperture therethrough for connection of the second arm and the rotation link to a conventional tool such as a bucket using a pair of selectively removable attachment pins 33. The attachment pins 33 are insertable in the apertures to pivotally connect the conventional tool directly to the second arm and the rotation link. When using the conventional tool, this permits the tool to be rotated about the attachment pin of the second arm 20 upon movement of the rotation link 24 relative to the second arm as a result of extension or retraction of the hydraulic cylinder 30 to rotate the conventional tool in the forward rotation plane defined by the first and second arms 14 and 20.

In the embodiment of the invention shown in FIG. 1, a conventional bucket 34 of relatively narrow width is utilized. The bucket has a toothed working edge 35 extending laterally, generally transverse to the forward rotation plane of the bucket. The bucket 34 further includes a first and second bucket clevises 36 and 38, with the first bucket clevis located toward the bucket working edge 35 and second bucket clevis 38 located forwardwardly of the first bucket clevis and away from the bucket working edge. The first and second bucket clevises are in general parallel alignment with the forward rotation plane of the bucket. It should be understood that the present invention may be practiced using other tools as work implements, and is not limited to just operation with buckets.

Figure 2:
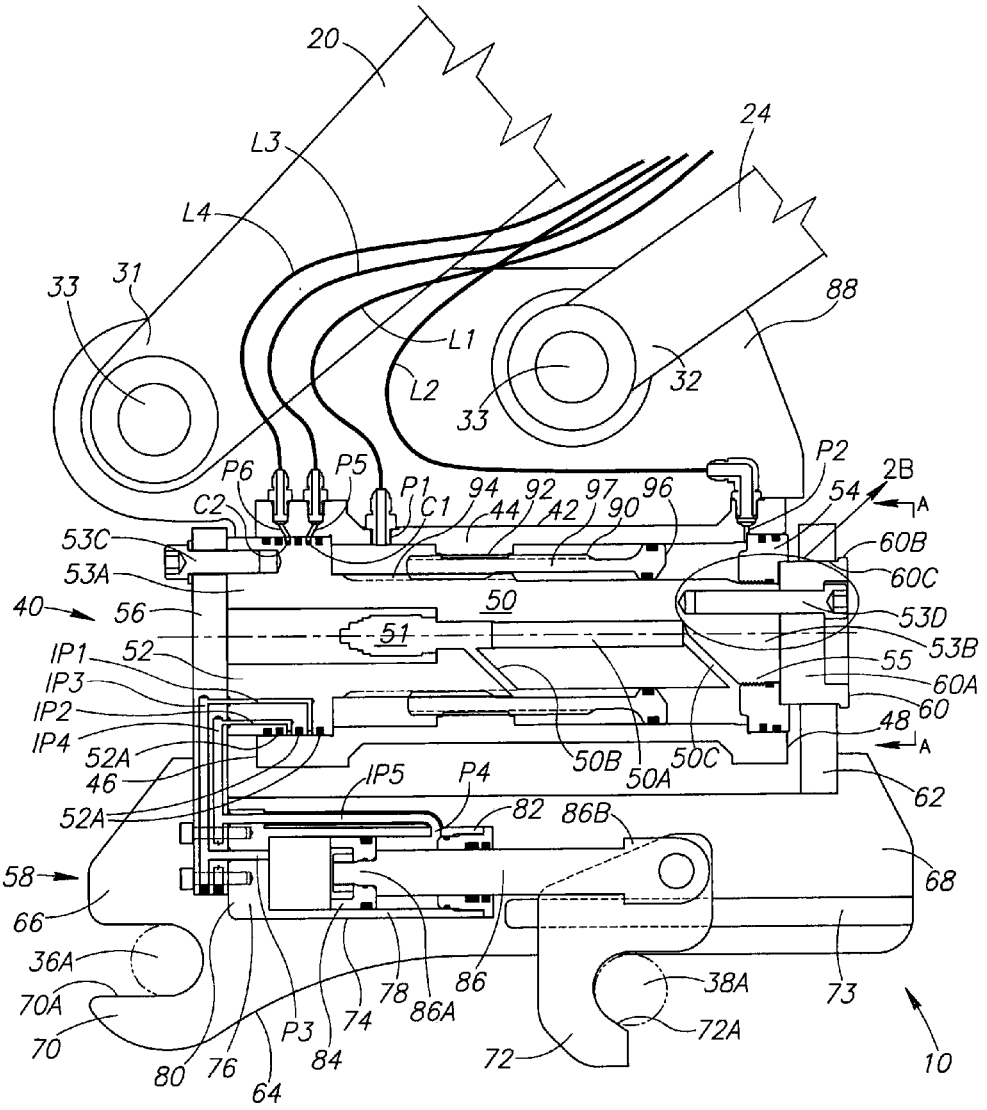
FIG. 2 is an enlarged, fragmentary, right side, cross-sectional view of a first embodiment of the tool assembly of FIG. 1.

The tool assembly 10 of the present invention includes a hydraulic rotary actuator 40. One version of the rotary actuator 40 is shown in FIG. 2. The second arm 20 of the vehicle 12 is shown tucked under the first arm 14 to position the bucket 34 or other tool attached to the tool assembly 10 for better visibility by the operator in the vehicle 12 when attaching or detaching the tool. The rotary actuator 40 has an elongated housing or body 42 with a sidewall 44 and first and second body ends 46 and 48, respectively. An elongated rotary drive or output shaft 50 is coaxially positioned within the body 42 and supported for rotation relative to the body about a longitudinal axis.

The shaft 50 extends the full length of the body 42, and has a flange portion 52 at the first body end 46. The shaft has a shaft first end portion 53A at the first body end 46 and a shaft second end portion 53B at the second body end 48. The shaft 50 has an annular carrier or shaft nut 54 threadably attached thereto at the second body end 48. The shaft nut 54 has a threaded interior portion threadably attached to a correspondingly threaded perimeter portion 55 of the shaft 50, and the shaft nut rotates with the shaft. The shaft nut 54 is locked in place against rotation relative to the shaft 50 as the shaft rotates during operation of the rotary actuator 40.

A seal is disposed between the shaft nut 54 and the shaft 50 to provide a fluid-tight seal therebetween. Seals 52A are disposed between the shaft flange portion 52 and the body sidewall 44 at the first body end 46 to provide a fluid-tight seal therebetween. Radial bearing may also be disposed between the shaft flange portion 52 and the body sidewall 44 to support the shaft 50 against radial thrust loads.

A first attachment flange 56 is positioned outward of the body 42 at the first body end 46 and is rigidly attached to the shaft first end portion 53A at the first body end for rotation with the shaft 50 relative to the body 42. The first attachment flange 56 abuts against the outward end face of the shaft first end portion 53A for support and is bolted thereto by a plurality of circumferentially arranged bolts 53C (only one being illustrated in FIG. 2). The first attachment flange 56 has the rotational drive of the shaft 50 transmitted thereto so as to provide the torque needed for tilting the bucket 34 to the desired lateral tilt angle and for holding the bucket in that position while the bucket performs the desired work. The first attachment flange 56 does not move axially relative to the body 42. The first attachment flange 56 extends radially beyond the body sidewall 44 downwardly toward the bucket 34, and is rigidly attached to a tool attachment assembly 58 spaced below and away from the rotary actuator 40, and provided to achieve releasable attachment thereto of a tool such as the bucket 34 shown in FIG. 1.

A retainer member 60 is positioned outward of the body 42 at the second body end 48 and is rigidly attached to the shaft second end portion 53B at the second body end for rotation with the shaft 50 relative to the body 42. The retainer member 60 retains a second attachment flange 62 outward of the body 42 at the second body end 48.

Figure 2A:
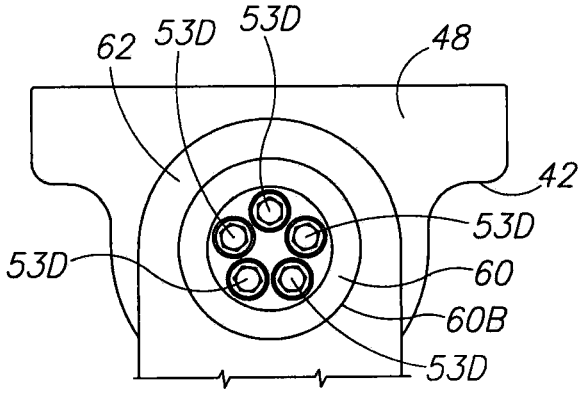
FIG. 2A is a partial rear end view of the actuator of FIG. 2, shown taken substantially along the line A-A of FIG. 2.

The retainer member 60 has a rearward end abutting against the outward end face of the shaft second end portion 53B for support and is bolted thereto by a plurality of circumferentially arranged bolts 53D, with five bolts 53D being illustrated by way of example in FIG. 2A. The rearward end portion of the retainer member 60 is received in a recess in a forward end face of the shaft nut 54. The retainer member 60 has a cylindrical body portion 60A with a radially outward extending flange 60B at a forward end thereof. The body portion 60A extends through a cylindrical aperture 60C of the second attachment flange 62. The second attachment flange 62 is rotatably retained on the body portion 60A in position between the shaft second end portion 53B and the retainer member flange 60B. The second attachment flange 62 does not move axially relative to the body 42. The second attachment flange 62 extends radially beyond the body sidewall 44 downwardly toward the bucket 34, and is rigidly attached to the tool attachment assembly 58. The first and second attachment flanges 56 and 62 hold the tool attachment assembly 58 suspended below and space away from the rotary actuator 40.

The tool attachment assembly 58 has a support frame 64 with a rearward end portion 66 to which the first attachment flange 56 is rigidly attached, and a forward end portion 68 to which the second attachment flange 62 is rigidly attached. A pair of laterally spaced-apart rear forks 70 which each have a rearward facing opening 70A (only one fork being visible in FIG. 2) are rigidly attached to the support frame 64 at the rearward end portion 66 thereof and project downward to a position for releasable attachment to a tool such as the bucket 34 shown in FIG. 1. Positioned forward of the rear forks 70 are a pair of laterally spaced-apart front forks 72 which each have a forward facing opening 72A (again only one fork being visible in FIG. 2) and project downward to a position for releasable attachment to a tool. The front forks 72 are retained against significant lateral movement relative to the support frame 64, but are movably supported by the support frame for reciprocal forward and rearward longitudinal movement of the front forks relative thereto and to the rear forks 70 to allow adjustable spacing between the front and rear forks to facilitate their releasable attachment to a tool. The longitudinal movement of the front forks 72 is guided by left and right side longitudinally extending guide slots 73 (only the left side guide slot being visible in FIG. 2) to maintain a linear movement of the front forks.

The tool attachment assembly 58 further includes a hydraulic linear actuator 74 supported by the support frame 64. The linear actuator 74 has an elongated housing or body 76 with a sidewall 78, and rearward and forward body ends 80 and 82, respectively. A piston 84 is disposed within the body 76 for linear reciprocating movement therein between the rearward and forward body ends 80 and 82 along a longitudinal axis. An elongated shaft 86 is coaxially positioned within the body 76 and supported for linear longitudinal movement relative thereto. A rearward end 86A of the shaft 86 is attached to the piston 84 for movement therewith. The shaft 86 extends forwardly out to the forward body end 82 and a forward end 86B of the shaft 86 is attached to the front forks 72 to move the front forks forward and rearward in response to movement of the piston 84 for selectively adjusting the spacing between the rear and front forks 70 and 72 to facilitate their releasable attachment to a tool. In the illustrated embodiment, the linear actuator 74 is a hydraulic cylinder.

The first and second attachment flanges 56 and 62 support the tool attachment assembly 58 with the linear actuator 74 spaced below and away from the rotary actuator 40 and in general parallel longitudinal alignment with the rotary actuator 40. The longitudinal axis of the rotary actuator 40 and the longitudinal axis of the linear actuator 74 are offset from each other in a generally parallel arrangement. The support frame 64 and hence the rear and front forks 70 and 72 rotate with the first and second attachment flanges 56 and 62 in response to rotation of the shaft 50 of the rotary actuator 40 about the same axis of rotation as the shaft 50 of the rotary actuator 40 when the rotary actuator is operated to tilt right or left the bucket 34 or other tool attached to the tool attachment assembly 58. By the hydraulic operation of the rotary actuator 40, the shaft 50 can be selectively rotated clockwise and counterclockwise (when viewed from rearward of the first body end 46 of the body 42) to selectively rotate the first and second attachment flanges 56 and 62 clockwise (i.e., tilt to the left) and counterclockwise (i.e., tilt to the right), and though their attachment to the tool attachment assembly 58, to rotate the linear actuator 74 clockwise and counterclockwise as a unit with the shaft 50.

While the retainer member 60 is securely attached to the shaft 50, and the second attachment flange 62 is mounted on the retainer member 60 for rotation with the shaft 50 relative to the body 42, as does the first attachment flange 56, the second attachment flange is not constructed to transmit rotational drive to the bucket 34 to provide the torque needed to tilt the bucket, as is the case with the first attachment flange 56. Nevertheless, the second attachment flange 62 will rotate with the shaft 50 as a result of the rotational drive transmitted thereto through the first attachment flange 56 via the tool attachment assembly 58. The second attachment flange 62 primarily serves to transmit the rotational force to the bucket 34 produced by the movement of the rotation link 24 relative to the second arm 20 in order to cause the bucket to be selectively rotated through the forward rotation plane. The entire bucket assembly 10, and hence the bucket 34 comprising a part thereof, rotates about the attachment pin 33 of the second arm 20 as the rotation link 24 is moved relative to the second arm by the hydraulic cylinder 30.

As will be described below, the body 42 of the rotary actuator 40 is pivotally attached to the second arm 20 and the rotation link 24, much in the same manner as a conventional bucket would be attached.

The attachment of the bucket 34 to the tool assembly 10 will be described for the bucket being attached with its working edge 35 located toward the vehicle 12, but it should be understood that the bucket and most any other tool used with the tool assembly 40 can be reversed. The two rear forks 70 of the tool attachment assembly 58 are laterally spaced apart and have the openings 70A sized for mating with a laterally extending pin 36A of the corresponding first bucket clevis 36, and the two front forks 72 of the tool attachment assembly are spaced apart and have the openings 72A sized for mating with a laterally extending pin 38A of the corresponding second bucket clevis 38 for releasable attachment of the bucket 34 to the tool assembly 10 at a position below the rotary actuator 40 and also below the linear actuator 74. The openings 70A and 72A of the rear and front forks 70 and 72 face in opposite directions and are sized and oriented to receive and securely hold the pins 36A and 38A of the first and second clevises 36 and 38 securely therein for performing work with the bucket 34 or other tool connected to the tool assembly, but permit quick attachment and release of the bucket or other tool when desired.

With the tool assembly 10 moved to position the pin 36A of the first bucket clevis 36 within the openings 70A of the rear forks 70, and the front forks between the pins of the first and second bucket clevis 36 and 38, the piston 84 of the linear actuator 74 is moved toward the forward body end 82 of the body 76 of the linear actuator to extend the shaft 86 further out of the body sufficiently to place the pin 38A of the second bucket clevis 38 securely in the openings 72A of the front forks 72. In this locking position, the bucket 34 or other tool is securely attached to the tool assembly 10 and ready to be used to perform work. To detach the bucket 34 or other tool from the tool assembly 10, the piston 84 of the linear actuator 74 is moved toward the rearward body end 80 of the body 76 of the linear actuator to retract the shaft 86 further into the body sufficiently to move the front forks 72 rearward into a release position where free of the pin 38A of the second bucket clevis 38 and the distance between the rear and front forks 70 and 72 is sufficiently less than the distance between the pins 36A and 38A of the first and second clevis 36 and 38 so that the tool assembly 10 can be moved to release the pins from both the rear and front forks, and hence the bucket 34 or other tool can be removed and replaced with another tool. By the selective extension and retraction of the linear actuator 74, one tool can be quickly and conveniently removed from the tool assembly 10 for attachment of another tool, or for reversal of the tool. This allows for quick and easy attachment of a different size or style bucket or other tools as a job demands. Also, the linear actuator 74 can be adjusted to move the rear and front forks 70 and 72 apart by selected distances of varying amounts to accommodate buckets and other tools with clevis pins having different inter-pin spacing, and thereby still securely clamp the pins between the rear and front forks.

It should be noted that while the rear and front forks 70 and 72 are shown and described as being outwardly facing, the orientation of the rear and front forks can be reversed. With such an arrangement, the shaft 86 of the linear actuator 74 would be retracted further into the body 76 to move the rear and front forks 70 and 72 closer together to securely clamp the pins 36A and 38A of the first and second clevis 36 and 38 between the rear and front forks. Further, it is understood that this invention applies broadly to tool attachment assemblies differing in construction from the described tool attachment assembly 58. For example, it applies to tool attachment assemblies which are operated by other means than fluid, or engage with working tools such as buckets which do not have pins 36A and 38A but another means for connecting with and disconnecting from the attachment assembly.

The tool assembly 10 includes a pair of attachment brackets 88 rigidly attached to the body 42 of the rotary actuator 40 to detachably connect the tool assembly to the second arm 20 and the rotation link 24 in a position therebelow in general alignment with the forward rotation plane. The attachment brackets 88 form first and second attachment clevis with apertures therein each sized to receive one of the attachment pins 33 to pivotally connect the tool assembly 10 to the vehicle second arm 20 at its free end portion 31, and to pivotally connect the tool assembly to the rotation link 24 at its free end portion 32. By the use of selectively removable attachment pins 33, the tool assembly 10 can be removed from the second arm 20 and the rotation link 24 when use of the tool assembly is not desired.

With the tool assembly 10 of the present invention, a compact, fluid-powered rotary actuator 40 is used with a design which requires far less space, particularly with respect to the size in the lateral direction compared to when using double-acting cylinders to rotate a tilt bucket. This allows the construction of a tiltable bucket assembly with a very narrow width bucket. Furthermore, the bucket assembly can be used with conventional buckets and thus can be retrofitted onto vehicles with existing buckets without requiring purchase of a new bucket.

The rotary actuator 40 uses an annular piston sleeve 90 coaxially and reciprocally mounted within the body 42 coaxially about the shaft 50. The piston sleeve 90 has a piston head 96 and a splined sleeve portion 97 with outer straight splines over a portion of its length which mesh with inner straight splines 92 of a splined intermediate interior portion of the body sidewall 44. Alternatively, the outer splines of the splined sleeve portion 97 and the inner splines 92 of the splined intermediate interior portion of the body sidewall 44 may be helical splines. The sleeve portion 97 is also provided with inner helical splines which mesh with outer helical splines 94 provided on a splined end portion of the shaft 50 toward the first body end 46. It should be understood that while splines are shown in the drawings and described herein, the principle of the invention is equally applicable to any form of linear-to-rotary motion conversion means, such as balls or rollers, or other means such as where the body and the piston sleeve have non-circular cross-sectional shapes, as will be described with another illustrated embodiment of the invention.

In the embodiment of the invention illustrated in FIG. 2, the piston head 96 of the piston sleeve 90 is annular in shape and positioned toward the second body end 48 with the shaft 50 extending therethrough. The piston head 96 is slidably maintained within the body 42 for reciprocal movement, and undergoes longitudinal and rotational movement relative to the body sidewall 44.

Seals are disposed between the piston head 96 of the piston sleeve 90 and a smooth interior wall portion of the body sidewall 44 to provide a fluid-tight seal therebetween. Seals are disposed between the piston head 96 and a smooth exterior wall surface 102 of the shaft 50 to provide a fluid-tight seal therebetween.

As will be readily understood, reciprocation of the piston head 96 within the body 42 of the rotary actuator occurs when hydraulic fluid, such as oil, air or any other suitable fluid, under pressure selectively enters through one or the other of a first port P1 which is in fluid communication with a fluid-tight compartment within the body to a side of the piston head toward the first body end 46 or through a second port P2 which is in fluid communication with a fluid-tight compartment within the body to a side of the piston head toward the second body end 48. As the piston head 96 and the piston sleeve 90, of which the piston head is a part, linearly reciprocates in an axial direction within the body 40, the outer helical splines of the sleeve portion 97 engage or mesh with the inner helical splines 92 of the body sidewall 44 to cause rotation of the piston sleeve. The linear and rotational movement of the piston sleeve 90 is transmitted through the inner helical splines of the sleeve portion 97 to the outer helical splines 94 of the shaft 50 to cause the shaft 50 to rotate. The smooth wall surface of the shaft 50 and the smooth wall surface of the body sidewall 44 have sufficient axial length to accommodate the full end-to-end reciprocating stroke travel of the piston sleeve 90 within the body 42. Longitudinal movement of the shaft 50 is restricted, thus all movement of the piston sleeve 90 is converted into rotational movement of the shaft 50. Depending on the slope and direction of turn of the various helical splines, there may be provided a summing of the rotary output of the shaft 50.

The application of fluid pressure to the first port P1 produces axial movement of the piston sleeve 90 toward the second body end 48. The application of fluid pressure to the second port P2 produces axial movement of the piston sleeve 90 toward the first body end 46. The rotary actuator 40 provides relative rotational movement between the body 42 and shaft 50 through the conversion of linear movement of the piston sleeve 90 into rotational movement of the shaft, in a manner well known in the art. The shaft 50 is selectively rotated by the application of fluid pressure, and the rotation is transmitted to the bucket 34 or other tool through the first attachment flange 56 to selectively tilt the attached bucket or other tool laterally, left and right.

The shaft 50 has an axially extending central aperture 50A which extends between the first body end 46 partially to the second body end 48. A relief valve 51 is positioned within the central aperture 50A and threadably attached to a threaded portion of the interior wall of the central aperture 50A of the shaft 50. A fluid passageway 50B communicates between the relief valve 51 and the fluid-tight compartment within the body 42 to the side of the piston head toward the first body end 46 and a fluid passageway 50C communicates between the relief valve and the fluid-tight compartment within the body to the side of the piston head toward the second body end 48. The positioning of the relief valve 51 within the central aperture avoids its interference with operation of the tool assembly 10.

As will also be readily understood, linear reciprocation of the piston 84 within the body 76 of the linear actuator 74 occurs when hydraulic oil, air or any other suitable fluid under pressure selectively enters through one or the other of a third port P3 which is in fluid communication with a fluid-tight compartment within the body to a side of the piston toward the rearward body end 80 or through a fourth port P4 which is in fluid communication with a fluid-tight compartment within the body to a side of the piston toward the forward body end 82. As the piston 84 linearly reciprocates in an axial direction forward and rearward within the body 76, the piston applies a linear force on the forward end of the shaft 86 which the shaft delivers to the front forks 72 to move the front forks forward and rearward, respectively, to adjust the spacing between the rear and front forks 70 and 72. The application of fluid pressure to the third port P3 produces axial movement of the piston 84 toward the forward body end 82 and hence forward movement of the front forks 72. The application of fluid pressure to the fourth port P4 produces axial movement of the piston 84 toward the rearward body end 80 and hence rearward movement of the front forks 72.

Figure 2B:
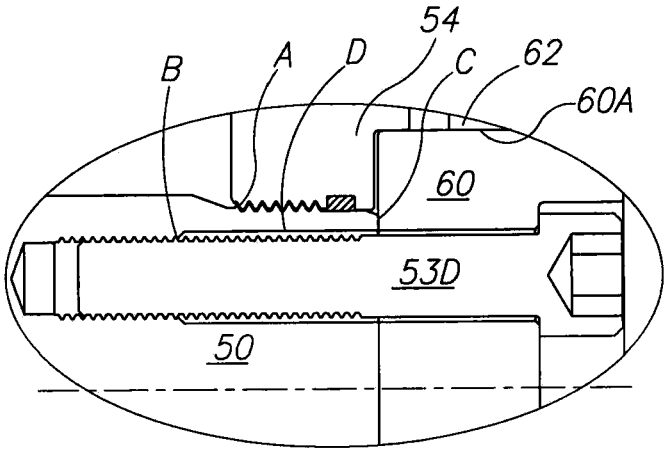
FIG. 2B is an enlarged portion of the actuator of FIG. 2 shown substantially within the oval 2B of FIG. 2.
Figure 2C:
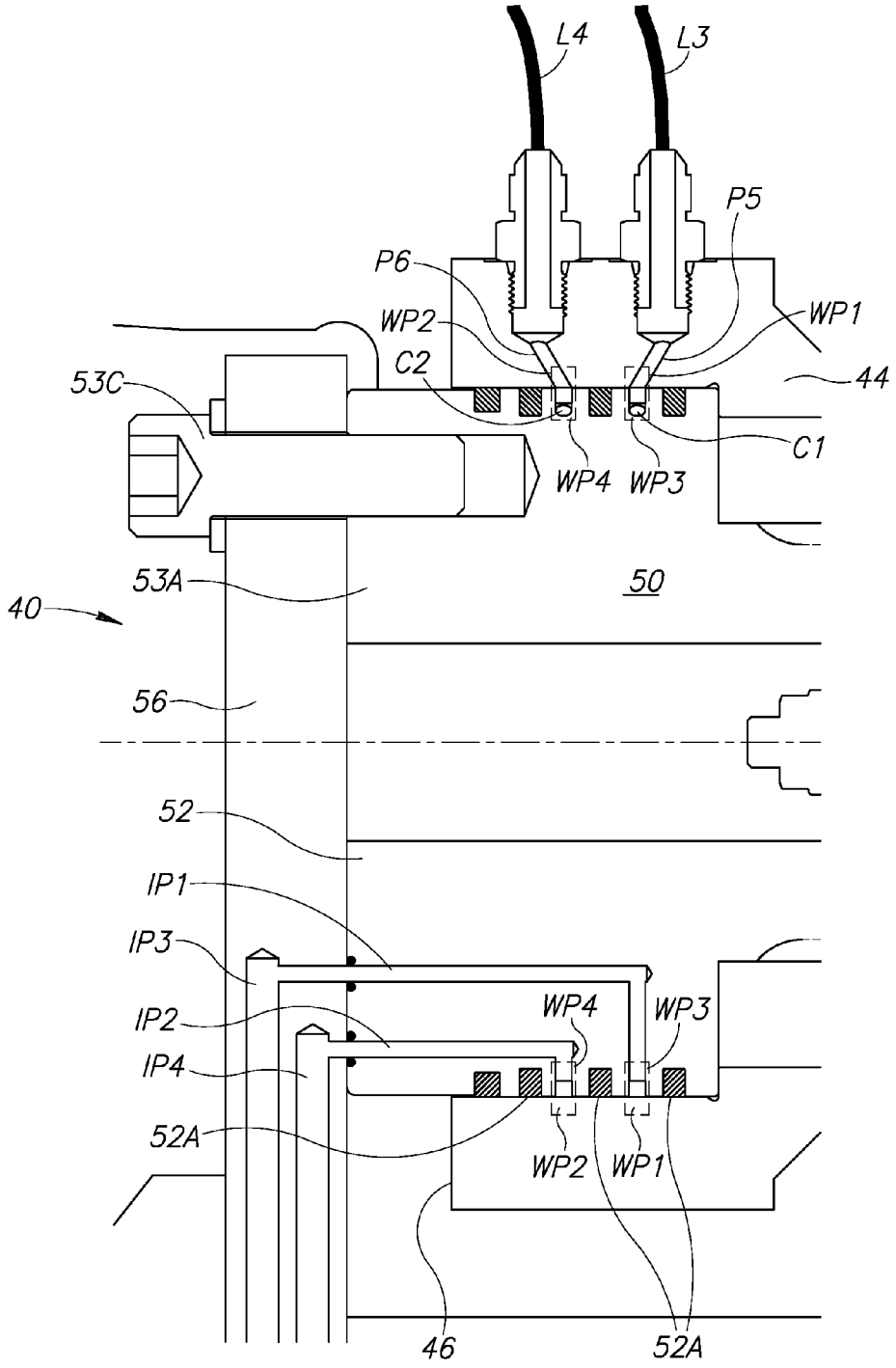
FIG. 2C is an enlarged portion of the actuator of FIG. 2 showing first and second wall portions of the actuator body and third and fourth wall portions of the actuator shaft.

Hydraulic fluid is communicated to the first and second ports P1 and P2 of the rotary actuator 40 by hydraulic lines L1 and L2, respectively, connected directly to the first and second ports P1 and P2 to control operation of the rotary actuator. While hydraulic fluid could be connected directly to the third and fourth ports P3 and P4 of the linear actuator 74, the lines would by necessity be in locations where they could contact or become entangled with objects in the work environment and be damaged, and take up space. To avoid this, hydraulic fluid is communicated to the third and fourth ports P3 and P4 of the linear actuator 74 by hydraulic lines L3 and L4, respectively, using various passageways interior to the rotary actuator, the first attachment flange 56 and the support frame 64 without using additional exterior hydraulic lines. The hydraulic line L3 is directly connected to a fifth port P5 provided in a circumferentially extending first wall portion WP1 of the body sidewall 44 of the rotary actuator 40 toward the first body end 46 of the body 42 at a location toward an upper side of the body, and the hydraulic line L4 is directly connected to a sixth port P6 provided in a circumferentially extending second wall portion WP2 of the body sidewall 44 of the rotary actuator 40 toward the first body end 46 of the body 42 also at a location toward an upper side of the body and adjacent to the fifth port P5. The shaft flange portion 52 of the shaft 50 in combination with the correspondingly located portion of the sidewall 44 of the body 42 form an oil gland used to communicate the hydraulic fluid from hydraulic lines L3 and L4 to the third and fourth ports P3 and P4 of the linear actuator 74. The periphery of the shaft flange portion 52 of the shaft 50 of the rotary actuator 40, at a location radially inward from the fifth port P5, has a first circumferential channel C1, located between the first wall portion WP1 of the body 42 and a circumferentially extending third wall portion WP3 of the shaft flange portion 52 which is in fluid communication with the fifth port P5. Similarly, periphery of the shaft flange portion 52 of the shaft 50 of the rotary actuator 40, at a location radially inward from the sixth port P6, has a second circumferential channel C2, located between the second wall portion WP2 of the body 42 and a circumferentially extending fourth wall portion WP4 of the shaft flange portion 52 which is in fluid communication with the sixth port P6. The first, second, third and fourth wall portions WP1, WP2, WP3 and WP4 are illustrated in FIG. 2C.

Fluid communication between the first and second circumferential channels C1 and C2 and the third and fourth ports P3 and P4 of the linear actuator 74 is accomplished by first and second internal passageways IP1 and IP2 in the shaft flange portion 52, third and fourth internal passageways IP3 and IP4 in the first attachment flange 56, and a fifth internal passageway IP5 in the form of an interiorly located tube welded in position. The first internal passageway IP1 of the shaft flange portion 52 has one end in communication with the first circumferential channel C1 at a location toward a lower side of the shaft 50 of the rotary actuator 40, and another end in communication with one end of the third internal passageway IP3 of the first attachment flange 56 at a location at the interface of the outward end face of the shaft first end portion 53A with the forward surface of the first attachment flange 56. The other end of the third internal passageway IP3 of the first attachment flange 56 is in communication with the third port P3 of the linear actuator 74. Somewhat similarly, the second internal passageway IP2 of the shaft flange portion 52 has one end in communication with the second circumferential channel C2 at a location toward a lower side of the shaft 50 of the rotary actuator 40, and another end in communication with one end of the fourth internal passageway IP4 of the first attachment flange 56 at a location at the interface of the outward end face of the shaft first end portion 53A with the forward surface of the first attachment flange 56. The other end of the fourth internal passageway IP4 of the first attachment flange 56 is in communication with one end of the fifth internal passageway IP5. The other end of the fifth internal passageway IP5 is in communication with the fourth port P4 of the linear actuator 74.

Circumferential seals are disposed between the first and second circumferential channels C1 and C2, and longitudinally outward of each channel. Additional seals are provided at the interfaces of the various component parts of the tool assembly to avoid fluid leakage at the junctions of the various internal passageways IP1 through IP5 with each other and with the third and fourth ports P3 and P4 of the linear actuator 74.

With the hydraulic system of the tool assembly 10 described above, the rotation of the tool assembly about the free end portion 31 of the second arm 20, the rotation of the tool attachment assembly 58 about the axis of the shaft 50 of the rotary actuator 40, and the linear movement of the front forks 72 relative to the rear forks 70 by the linear actuator 74 is controlled by the operator from within the cab of the vehicle 12.

As described above, the first attachment flange 56 is bolted to the shaft first end portion 53A by a plurality of circumferentially arranged bolts 53C, and the retainer member 60 is bolted to the shaft second end portion 53B by a plurality of circumferentially arranged bolts 53D, as illustrated in FIG. 2A. The bolts 53D have sufficient length to extend axially into the shaft 50 well beyond the distance necessary merely to secure the first attachment flange 56 and the retainer member 60 to the shaft. This distance is sufficient to significantly pre-stress/pre-load the shaft 50 when the bolts are tightened by placing the areas of the shaft which are threaded to receive the bolts 53D in compression and thereby help prevent fatigue failure and improve fatigue life. In the illustrated embodiment the distance is sufficient to create a pre-loading that is at least 50% of all axial forces the rotary actuator 40 is designed to experience during use, and preferably greater than all the axial forces applied to the end area of the shaft 50 where the bolts are located during operation of the rotary actuator, including forces created by the application of fluid pressure to the rotary actuator 40. This pre-stressing of the shaft 50 allows a shaft that would otherwise be limited to use with lower hydraulic pressures to operate at pressures above 3,000 psi and use a smaller shaft. With this arrangement, the shaft 50 of the rotary actuator 40 has improved resilience to cyclical loading.

The described pre-loaded design overcomes failures of the shaft 50 which typically occur at regions of stress concentrations such as threads or shaft to flange transitions under cyclical loading. The pre-loaded design has two mechanisms for improving fatigue life. It places the would be area of crack initiation and propagation under a compressive stress. It also reduces the magnitude of stress fluctuation in the member taking the tensile loads. To further explain reference is made to FIG. 2B. The location "A" is the location of the first loaded thread of the threaded attachment between the shaft 50 and the shaft nut 54 at the second body end 48. This is the typical failure point. The location "B" is the location of the start of threaded engagement of the bolt 53D to the shaft second end portion 53B for attaching the retainer member 60 to the shaft second end portion 53B. Location "C" is the location of the other point of pre-load where the retainer member 60 is positioned at the outward end of the shaft second end portion 53B. It should be noted that location "A" is well between locations "B" and "C", that is, in the compressive zone created by the tightly bolting the retainer member 60 to the shaft second end portion 53B at the second body end 48 with bolts 53D, which puts the portion of the shaft second end portion between locations "B" and "C" under a significant amount of compression. This is accomplished by drilling a plurality of recesses or holes "D" in the shaft second end portion 53B, each having an unthreaded portion and a threaded portion, with the threaded portion having its first thread to be threadably engaged by the threads of one of the bolts 53D at location "B," with the location "A" and the threads of the shaft 50 by which the shaft nut 54 is threadably attached to the shaft located between the location "B" and the location "C". As seen in FIG. 2B, the threaded portion of the hole "D" extends from location "B" toward the first body end 46. Again, this places the portion of the shaft second end portion 53B between locations "B" and "C" under compression (i.e., in a compression zone), and significantly pre-stresses/pre-loads the shaft 50 when the bolts 53D are tightened prior to operation of the rotary actuator 40.

Figure 3:
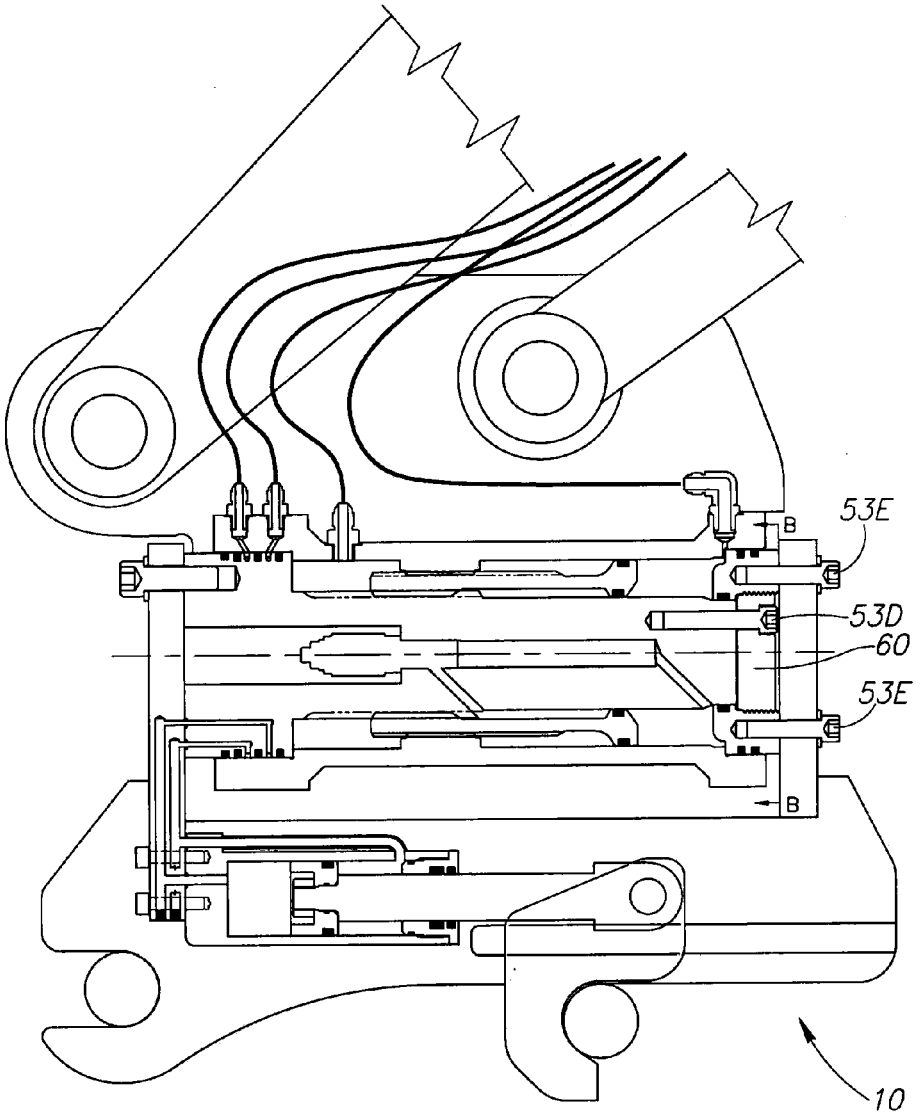
FIG. 3 is an enlarged, fragmentary, right side, cross-sectional view of a second embodiment of the tool assembly of FIG. 1.
Figure 3A:
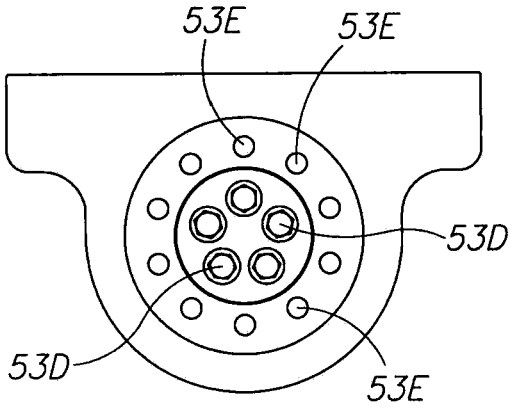
FIG. 3A is a partial cross-sectional view of the actuator of FIG. 3, shown taken substantially along the line B-B of FIG. 3.

A second embodiment of the fluid-powered, laterally tiltable tool assembly 10 is shown in FIG. 3 having a similar construction to the tool assembly of FIG. 2, except the retainer member 60 is not used to rotatably retain the second attachment flange 62. Instead, the second attachment flange 62 is bolted directly to the shaft nut 54 by a plurality of circumferentially arranged bolts 53E positioned radially outward of the bolts 53D attaching the retainer member 60 to the shaft second end portion 53B at the second body end 48 of the body 42 of the rotary actuator 40, as illustrated in FIG. 3A.

Figure 4:
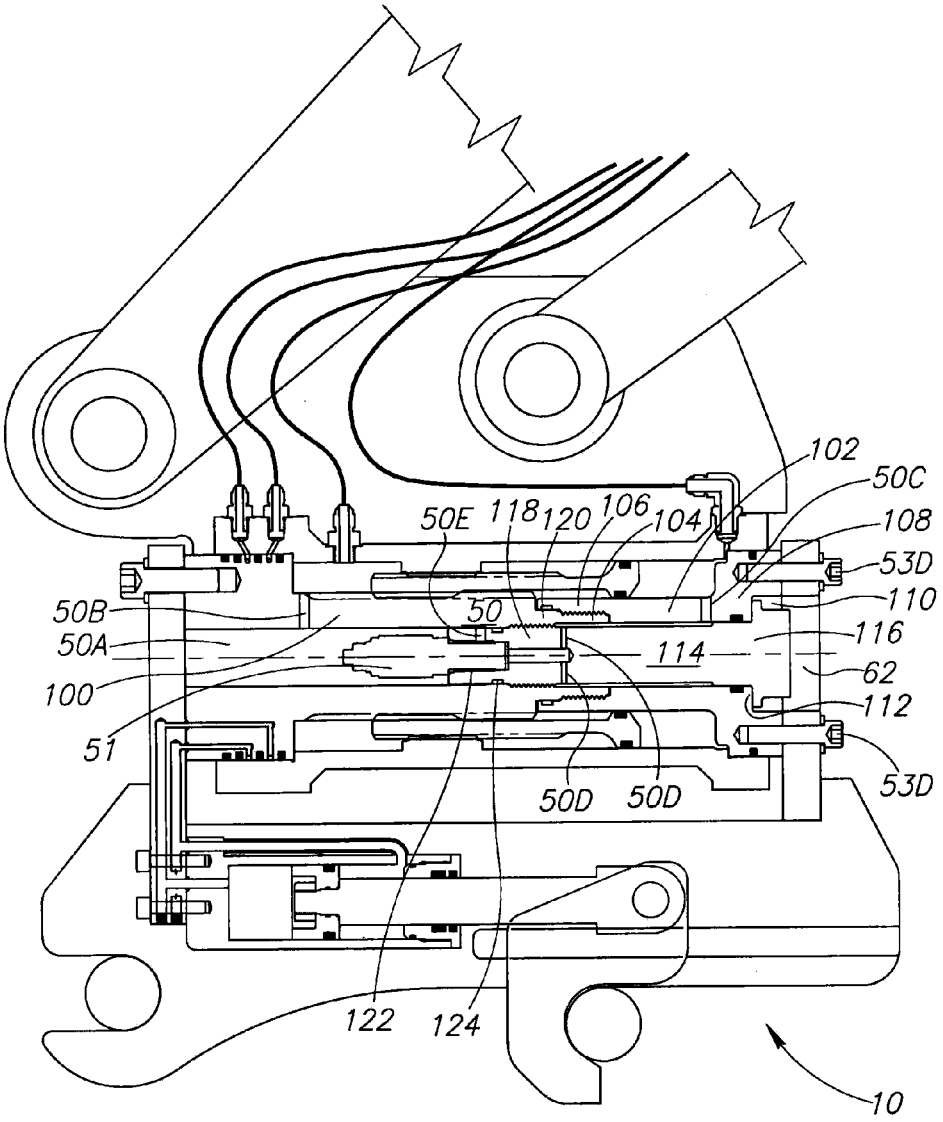
FIG. 4 is an enlarged, fragmentary, right side, cross-sectional view of a third embodiment of the tool assembly of FIG. 1.

A third embodiment of the fluid-powered, laterally tiltable tool assembly 10 is shown in FIG. 4 having a similar construction to the tool assembly of FIG. 2, except for several aspects of the rotary actuator 40 that will be described. In particular, the rotary actuator 40 shown in FIG. 4 utilizes a shaft 50 having a stub shaft portion 100 and an end cap portion 102. The stub shaft portion 100 extends from the first body end 46 partially toward the second body end 48 and terminates in an exteriorly threaded end portion 104, and the end cap portion 102 extends from the second body end partially toward the first body end and terminates in an interiorly threaded end portion 106 which is threadably receives the exteriorly threaded end portion 104 of the stub shaft portion therein. Further, the rotary actuator of this embodiment eliminates the use of the shaft nut 54 at the second body end 48 and instead the end cap portion 102 includes a flange portion 108 at the second body end to which the second attachment flange 62 is directly bolted by the bolts 53D without use of the intermediary retainer member 60. The exterior end face of the end cap portion 102 has an exteriorly open recess 110 therein.

Additionally, the shaft 50 of the rotary actuator 40 in this embodiment has an enlarged axially extending central aperture 50A which extends fully between the first body end 46 and the second body end 48, and opens at the second body end into the recess 110 of the end cap portion 102 and defines a shoulder 112 extending about the opening. The central aperture 50A is sized to receive a center bolt 114 therein. The center bolt 114 has a head 116 which is sufficiently large to engage the shoulder 112 within the recess 110, and an exteriorly threaded portion 118 which is positioned within the central aperture to be threadably received by an interiorly threaded portion 120 of the stub shaft portion 100 of the shaft 50 located toward its end toward the second body end 48 and about midway between the first and second body ends 46 and 48. Tightening of the center bolt 114 applies a significant pre-stress/pre-load on the shaft 50 by placing the length of the shaft between the head 116 of the center bolt and the interiorly threaded portion 120 of the stub shaft portion 100 of the shaft in compression. The use of the center bolt 114 helps achieve a desired pre-loading that is at least 50% of all axial forces for which the rotary actuator 40 is designed to experience during use, and preferably greater than all the axial forces applied to the shaft 50 during operation of the rotary actuator.

The rotary actuator 40 of this third embodiment of the tool assembly 10 shown in FIG. 4 has the relief valve 51 threadably received in a threaded recess 122 in an inward end portion of the center bolt 114, and a seal 124 positioned between the center bolt and the interior wall of the central aperture 50A of the shaft 50. A pair of fluid passageways 50D are provided in the center bolt 114 which communicate hydraulic fluid between the relief valve 51 and the central aperture 50A to a side of the seal 124 toward the second body end 48. A fluid passageway 50E is provided in the center bolt 114 which communicates hydraulic fluid between the relief valve 51 and the central aperture 50A to a side of the seal 124 toward the first body end 46.

Figure 5:
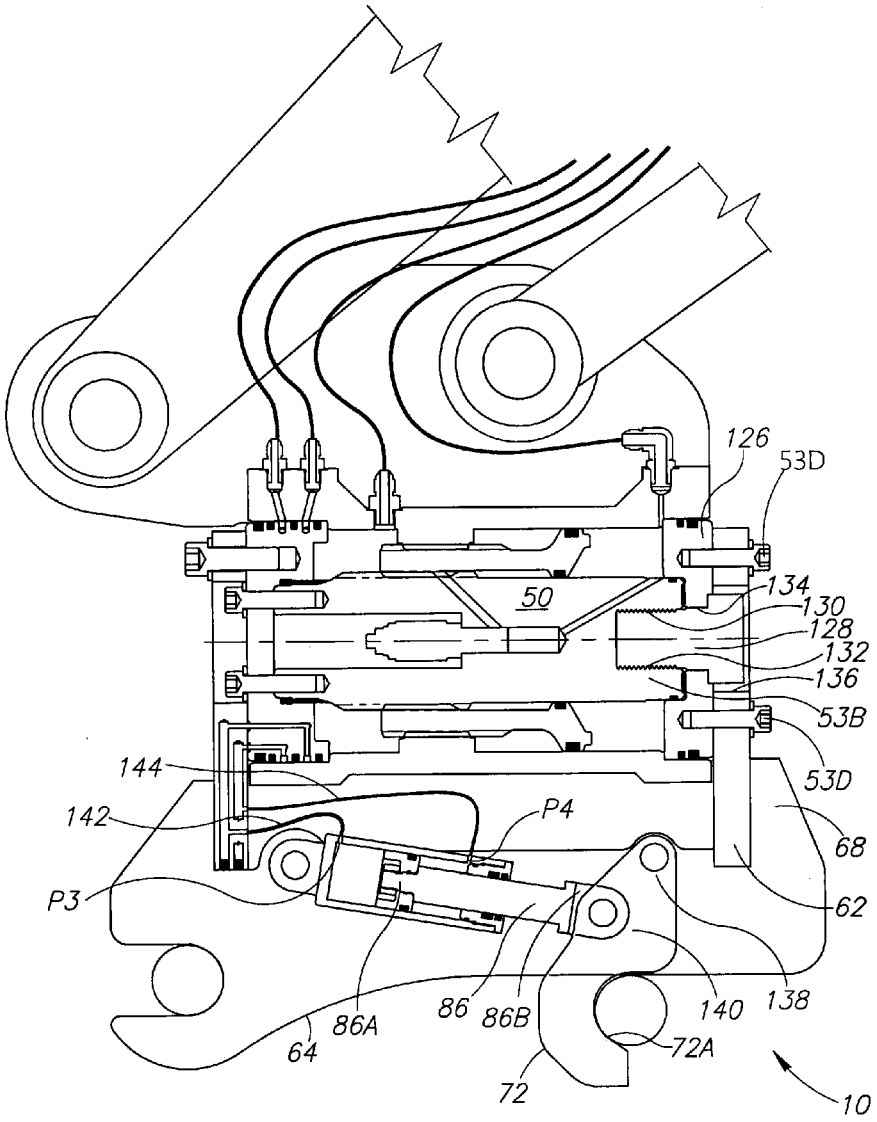
FIG. 5 is an enlarged, fragmentary, right side, cross-sectional view of a fourth embodiment of the tool assembly of FIG. 1.

A fourth embodiment of the fluid-powered, laterally tiltable tool assembly 10 is shown in FIG. 5 having a similar construction to the tool assembly of FIG. 2, except for several aspects of the rotary actuator 40 and the tool attachment assembly 58 that will be described. In particular, the rotary actuator 40 shown in FIG. 5 eliminates the use of the shaft nut 54 threadably attached the shaft 50 at the second body end 48 and instead uses an end cap 126 attached to the shaft by a central bolt 128. The shaft second end portion 53B at the second body end 48 has a threaded aperture 130 to threadably receive an exteriorly threaded portion 132 of the central bolt 128 and the end cap 126 has a central aperture 134 through which the central bolt passes. Tightening of the center bolt 128 applies a significant pre-stress/pre-load on the shaft 50 by placing the shaft second end portion 53B in compression. As shown in FIG. 5, in this embodiment the second attachment flange 62 is directly bolted to the end cap 126 by the bolts 53D without use of the intermediary retainer member 60. The second attachment flange 62 has a central aperture 136 in which a head portion of the central bolt 128 is positioned.

The tool attachment assembly 58 of this fourth embodiment of the tool assembly 10 shown in FIG. 5 has an end portion 138 of each of the front forks 72 spaced away from end thereof with the forward facing openings 72A pivotally coupled to the support frame 64 at a location toward the rearward end portion 68 thereof. The forward end 86B of the shaft 86 of the linear actuator 74 is pivotally coupled to a central portion 140 of each of the rear forks 72. In such manner, the reciprocating movement of the piston 84 of the linear actuator 74 causes the shaft 86 to pivot the front forks about their point of pivotal connection to the support frame 64 and thereby move the ends of the front forks 72 with forward facing openings 72A along a forward and rearward arcuate path.

The tool attachment assembly 58 of this fourth embodiment also has eliminated the fifth internal passageway IP5 in the support frame 64, and uses a hydraulic line 142 to connect the third internal passageway IP3 in the first attachment flange 56 to the third fluid port P3 of the linear actuator 74, and a hydraulic line 144 to connect the fourth internal passageways IP4 in the first attachment flange to the fourth fluid port P4 of the linear actuator.

Figure 6:
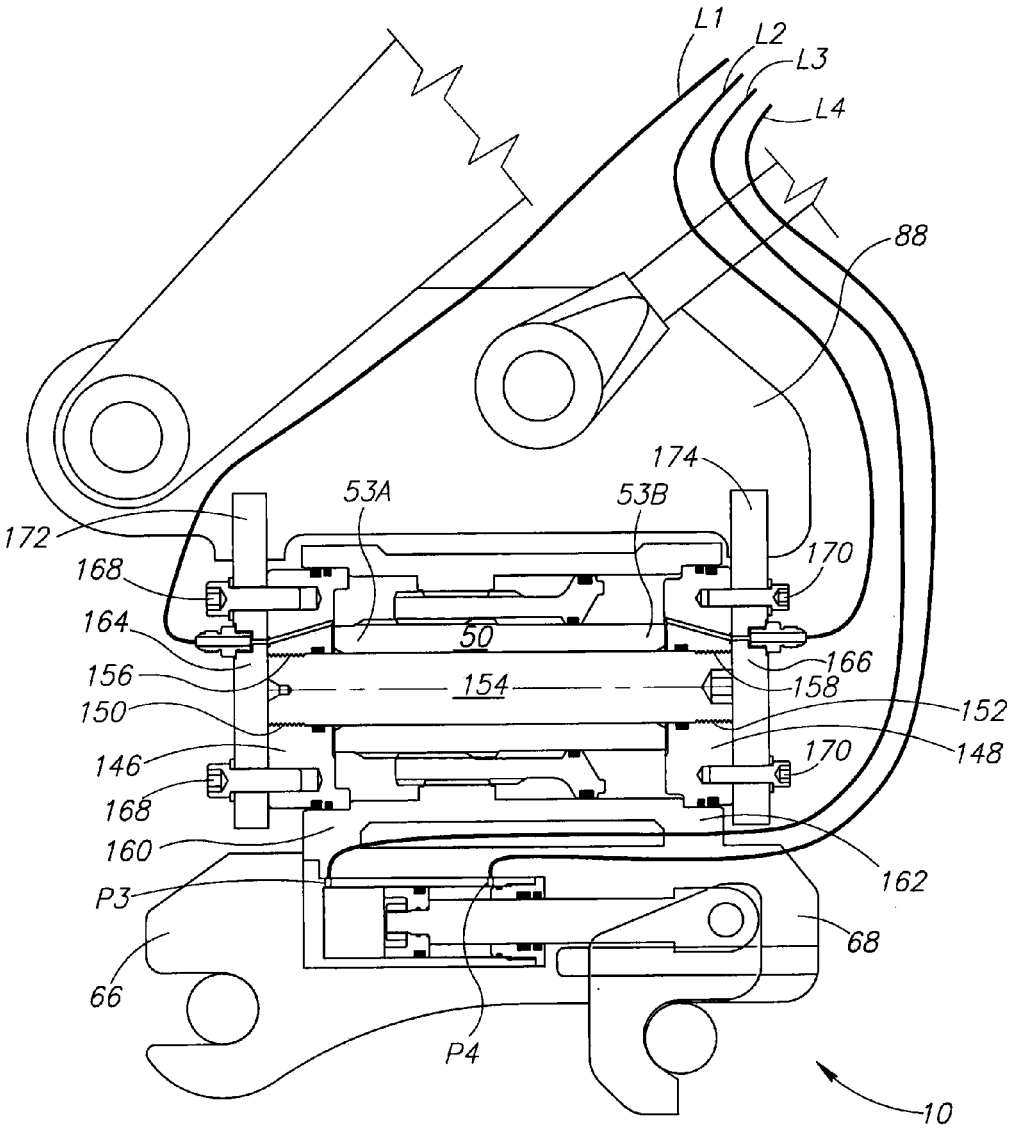
FIG. 6 is an enlarged, fragmentary, right side, cross-sectional view of a fifth embodiment of the tool assembly of FIG. 1.

A fifth embodiment of the fluid-powered, laterally tiltable tool assembly 10 is shown in FIG. 6. In this embodiment, the shaft 50 of the rotary actuator 40 does not extend the full length of the body 42, with the shaft first end portion 53A ending inward of the first body end 46 and the shaft second end portion 53B ending inward of the second body end 48. A first end cap 146 is located at the first body end 46 partially within the body 42 and extending axially forward and outward beyond the body, and a second end cap 148 is located at the second body end 48 partially within the body 42 and extending axially rearward and outward beyond the body. The first and second end caps 146 and 148 each have a threaded central aperture 150 and 152, respectively. A tie rod 154 extends with a threaded first end portion 156 and a threaded second end portion 158 extends between the first and second end caps 146 and 148, with the threaded first end portion 156 threadably received in the threaded central aperture 150 of the first end cap and the threaded second end portion 158 threadably received in the threaded central aperture 152 of the second end cap. The threads of the threaded first end portion 156 of the tie rod 154 and the threaded central aperture 150 of the first end cap 146 being of an opposite hand thread than the threaded second end portion 158 of the tie rod and the threaded central aperture 152 of the second end cap 148. In the illustrated embodiment, the threads of the threaded first end portion 156 of the tie rod 154 and the threaded central aperture 150 of the first end cap 146 are right hand threads, and the threads of the threaded second end portion 158 of the tie rod and the threaded central aperture 152 of the second end cap 148 are left hand threads. As a result, upon assembly of the rotary actuator 40, the tie rod 154 when threaded into the first and second end caps 146 and 148 can be rotated in a single rotational direction which simultaneously draws the first and second end caps inward and into tight engagement with the shaft first and second end portions 53A and 53B to firmly clamp the shaft 50 between the first and second end caps to apply a significant axial pre-stress/pre-load force to shaft. Torque transmission between the shaft 50 and the end caps 146 and 148 is aided by matching radially oriented face grooves in the shaft and end caps. The tie rod 154 extends beyond the shaft first and second end portion 53A and 53B, and is longer than the shaft 50.

In the embodiment of FIG. 6, the tie rod 154 is torqued, thereby preloading itself and the shaft 50, but when the hydraulic pressure is cycled on and off the stress in the tie rod fluctuates a relatively small amount compared to the fluctuating hydraulic force but instead the force between the first and second shaft end portions 53A and 53B and the first and second end caps 146 and 148 fluctuates. This has to do with the different spring rates of the loaded components or in this case primarily the cross sectional difference of the tie rod 154 and the shaft 50.

In this fifth embodiment of the tool assembly 10 shown in FIG. 6 the support frame 64 of the tool attachment assembly 58 is rigidly attached to the body 42 of the rotary actuator 40 by first and second attachment members 160 and 162, respectively, rather than being connected to the shaft 50 of the rotary actuator through the first and second attachment flanges 56 and 62 used in the embodiments described above. As will be described below, in this embodiment the shaft 50 is held stationary relative to the attachment brackets 88 by which the tool assembly 10 is detachably connected to the second arm 20 and the rotation link 24 of the vehicle 12, and operation of the rotary actuator 40 causes the body 42 to rotate. Since the support frame 64 of the tool attachment assembly 58 is rigidly attached to the body 42 in this embodiment, operation of the rotary actuator 40 to rotate the body 42 thereof also rotates the tool attachment assembly 58 and hence any tool to which it is attached.

The first attachment member 160 extends between the first body end 46 of the rotary actuator 40 and the rearward end portion 66 of the support frame 64, and the second attachment member 162 extends between the second body end 48 of the rotary actuator and the forward end portion 68 of the support frame. In the illustrated embodiment the attachment members 160 and 162 are body portions that integrally connect the body 42 of the rotary actuator 40 with the support frame 64 of the tool attachment assembly 58.

In this embodiment, since the body 42 of the rotary actuator 40 is rigidly attached to the support frame 64, the first and second attachment flanges 56 and 62 are not used to connect together the rotary actuator and the support frame 64 of the tool attachment assembly 58. However, similar first and second attachment flanges 164 and 166 are used, although in effect to attach the shaft 50 of the rotary actuator 40 to the attachment brackets 88. The first attachment flange 164 is positioned outward of the body 42 at the first body end 46 and the second attachment flange 166 is positioned outward of the body at the second body end 48. The first attachment flange 164 is rigidly attached to the first end cap 146 by a plurality of circumferentially arranged bolts 168 (only two being illustrated in FIG. 6), and the second attachment flange 166 is rigidly attached to the second end cap 148 by a plurality of circumferentially arranged bolts 170 (only two being illustrated in FIG. 6). Both an upper end portion 172 of the first attachment flange 164 and an upper end portion 174 of the second attachment flange 166 are rigidly attached to the pair of attachment brackets 88 at spaced apart forward and rearward locations (as before described, the attachment brackets 88 detachably connect the tool assembly 10 to the second arm 20 and the rotation link 24 of the vehicle 12). As such, in this embodiment the shaft 50, the end caps 146 and 148, and the first and second flanges 164 and 166 are held stationary relative the attachment brackets 88, rather than the body 42 of the rotary actuator 40. Thus, during operation of the rotary actuator 40, the shaft 50 is stationary and the body 42 of the rotary actuator rotates and laterally tilts the tool attachment assembly 58.

In this fifth embodiment of the tool assembly 10 shown in FIG. 6, internal passageways are not used to communicate hydraulic fluid with the third and fourth ports P3 and P4 of the linear actuator 74, instead the hydraulic lines L3 and L4 are connected directly to the third and fourth ports P3 and P4, respectively. Further, the relief valve 51 is not used.

Figure 7:
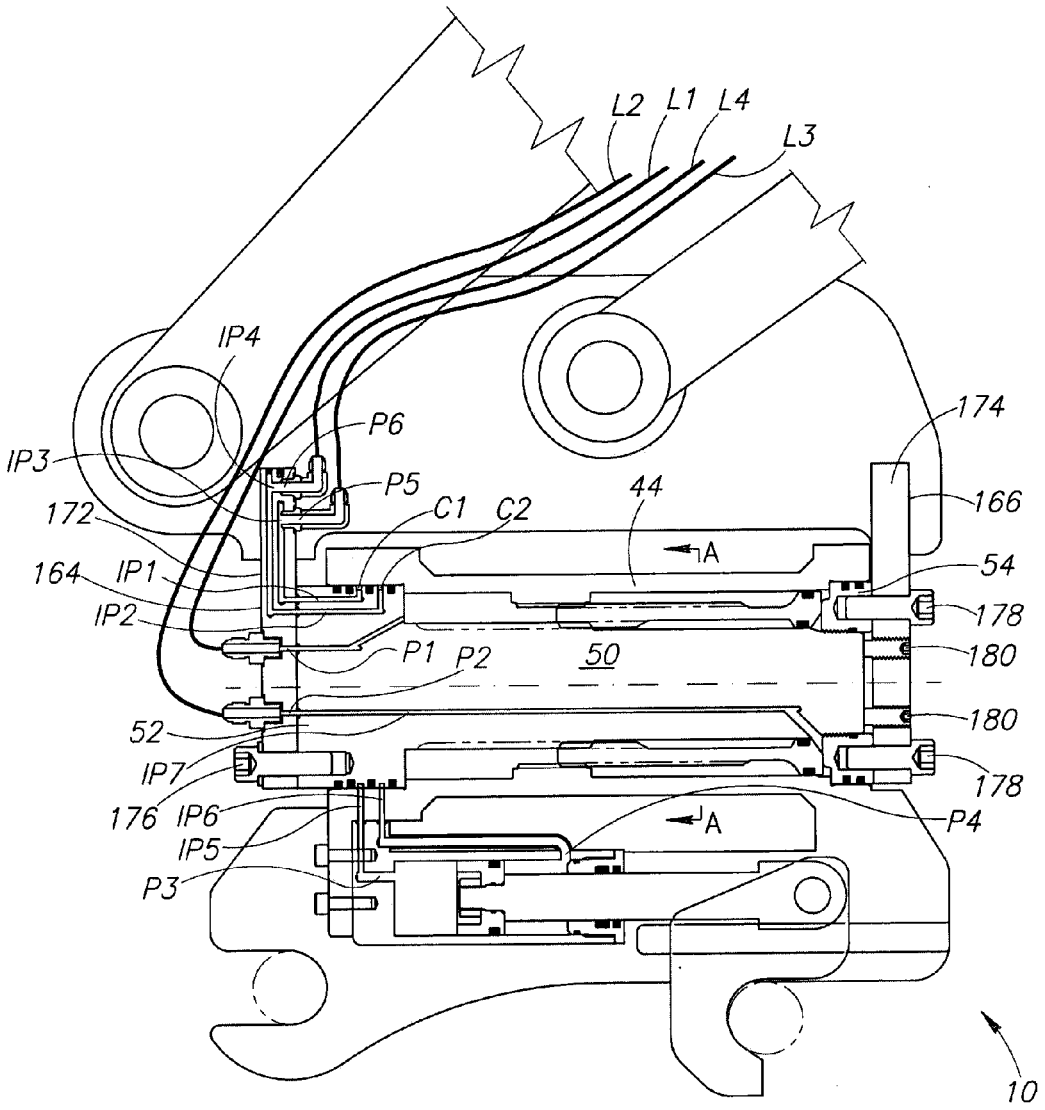
FIG. 7 is an enlarged, fragmentary, right side, cross-sectional view of a sixth embodiment of the tool assembly of FIG. 1.

A sixth embodiment of the fluid-powered, laterally tiltable tool assembly 10 is shown in FIG. 7 having a similar construction to the tool assembly of FIG. 6, however, without use of the tie rod 154 and with communication of hydraulic fluid more like described above for the tool assembly of FIG. 2. As with the embodiment of FIG. 2, in this sixth embodiment, the shaft 50 extends the full length of the body 42, and has the flange portion 52 at the first body end 46 and the shaft nut 54 at the second body end 48. As with the embodiment of FIG. 6, first and second attachment flanges 164 and 166 are used, with the upper end portions 172 and 174 thereof being rigidly attached to the pair of attachment brackets 88, and with the first attachment flange rigidly attached to the flange portion 52 of the shaft 50 at the first body end 46 by a plurality of circumferentially arranged bolts 176 (only one being illustrated in FIG. 7), and the second attachment flange 166 is rigidly attached to the shaft nut 54 at the second body end 48 by a plurality of circumferentially arranged bolts 178 (only two being illustrated in FIG. 7). In effect, the shaft 50 of the rotary actuator 40 is attached to the attachment brackets 88 and held stationary relative the attachment brackets 88, with the body 42 of the rotary actuator 40 being rotatable relative to the attachment brackets during operation of the rotary actuator 40 to laterally tilt the tool attachment assembly 58. A plurality of circumferentially arranged bolts 180 (only two being illustrated in FIG. 7) extend through threaded apertures in the second attachment flange 166 and extend inwardly to apply inward force on the outward end face of the shaft second end portion 53B to apply an axial pre-stress/pre-load force to the shaft 50 and attachment brackets 88.

Unlike in the embodiment of FIG. 6, in this sixth embodiment of FIG. 7, hydraulic fluid is not connected directly to the third and fourth ports P3 and P4 of the linear actuator 74. Rather, hydraulic fluid is communicated to the third and fourth ports P3 and P4 of the linear actuator 74 by hydraulic lines L3 and L4, respectively, using various passageways interior to the rotary actuator, the first attachment flange 164 and the support frame 64 without using additional exterior hydraulic lines. The hydraulic line L3 is directly connected to a fifth port P5 in the upper end portion 172 of the first attachment flange 164, and the hydraulic line L4 is directly connected to a sixth port P6 in the upper end portion of the first attachment flange, located adjacent to the fifth port P5. The periphery of the shaft flange portion 52 of the shaft 50 of the rotary actuator 40 has first and second circumferential channels C1 and C2. Fluid communication between the fifth and sixth ports P5 and P6 and the first and second circumferential channels C1 and C2 is accomplished by first and second internal passageways P3 and P4 in the first attachment flange 164, and third and fourth internal passageways P1 and P2 in the shaft flange portion 52. The first internal passageway IP3 of the first attachment flange 164 has one end in communication with the fifth port P5 and another end in communication with one end of the third internal passageway P1 of the shaft flange portion 52 at a location at the interface of the outward end face of the shaft first end portion 53A with the forward surface of the first attachment flange 164. The other end of the third internal passageway IP1 of the shaft flange portion 52 is in communication with the first circumferential channel C1 at a location toward an upper side of the shaft flange portion 52. Similarly, the second internal passageway IP4 of the first attachment flange 164 has one end in communication with the sixth port P6 and another end in communication with one end of the fourth internal passageway P2 of the shaft flange portion 52 at a location at the interface of the outward end face of the shaft first end portion 53A with the forward surface of the first attachment flange 164. The other end of the fourth internal passageway IP2 of the shaft flange portion 52 is in communication with the second circumferential channel C2 at a location toward an upper side of the shaft flange portion 52.

Fluid communication between the first and second circumferential channels C1 and C2 and the third and fourth ports P3 and P4 of the linear actuator 74 is accomplished by fifth and sixth internal passageways IP5 and IP6 in the body sidewall 44 of the rotary actuator 40 toward the first body end 46 of the body 42 located toward a lower side of the body adjacent to the rearward end portion 66 of the support frame 64 of the tool attachment assembly 58. The sixth internal passageway IP6 in part comprises an interiorly located tube welded in position and extending to the fourth port P4. The one end of the fifth internal passageway IP5 in communication with the first circumferential channel C1 at a location toward a lower side of the body 42 of the rotary actuator 40, and the other end is in communication with the third port P3 of the linear actuator 74. The one end of the sixth internal passageway IP6 in communication with the second circumferential channel C2 also at a location toward a lower side of the body 42 of the rotary actuator 40, and the other end is in communication with the fourth port P4 of the linear actuator 74.

Figure 7A:
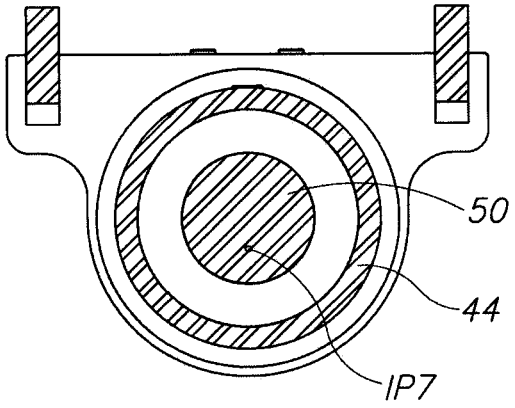
FIG. 7A is a partial cross-sectional view of the actuator of FIG. 7, shown taken substantially along the line A-A of FIG. 7.

In this sixth embodiment of the tool assembly 10 shown in FIG. 7, the hydraulic fluid is communicated to the first and second ports P1 and P2 of the rotary actuator 40 by hydraulic lines L1 and L2, respectively, connected directly to the first and second ports P1 and P2 to control operation of the rotary actuator. The second port P2 in this embodiment is located at the first body end 46 so a seventh internal passageways IP7 in the shaft communicates hydraulic fluid between the second port P2 and the fluid-tight compartment within the body 42 to a side of the piston head 96 toward the second body end 48. The seventh internal passageways IP7 is shown in FIG. 7A (the piston sleeve 90 has been deleted from FIG. 7A), as in the concentric arrangement of the cylindrical sidewall 44 of the body 42 of the rotary actuator 40 and the shaft 50 of the rotary actuator.

Figure 8:
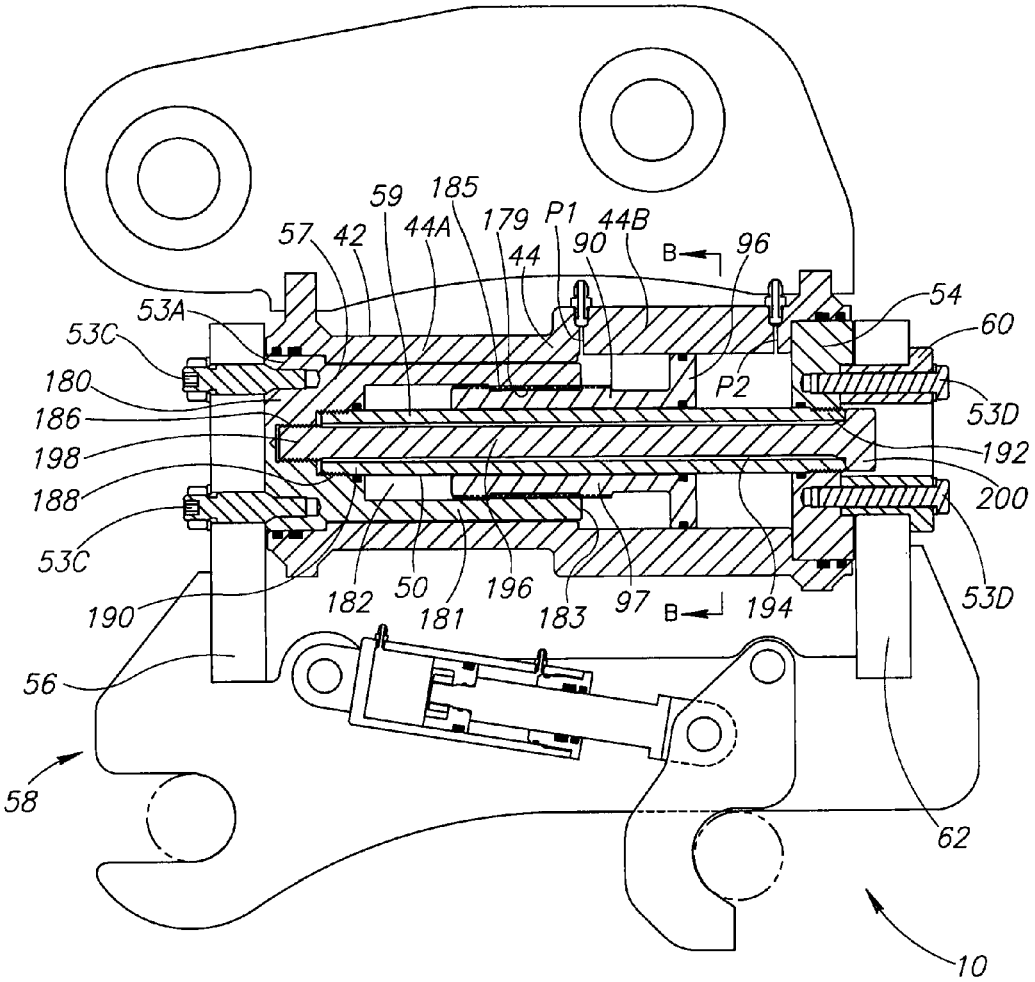
FIG. 8 is an enlarged, fragmentary, right side, cross-sectional view of a seventh embodiment of the tool assembly of FIG. 1, shown taken substantially along the line A-A of FIG. 8A.
Figure 8A:
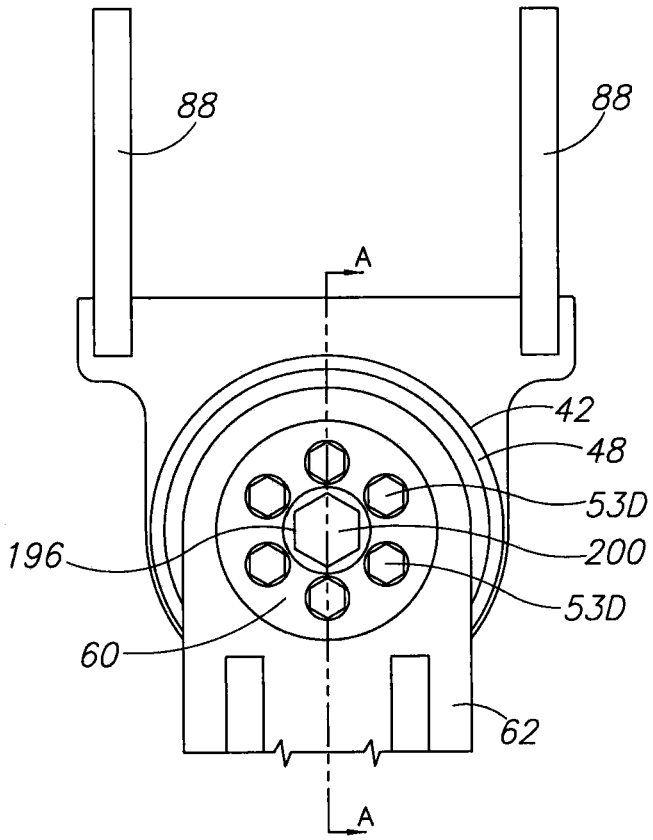
FIG. 8A is a fragmentary end view of the actuator of FIG. 8.
Figure 8B:
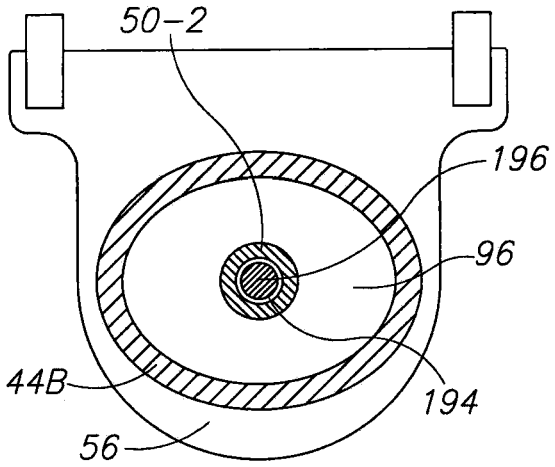
FIG. 8B is a partial cross-sectional view of the actuator of FIG. 8, shown taken substantially along the line B-B of FIG. 8.

A seventh embodiment of the fluid-powered, laterally tiltable tool assembly 10 is shown in FIGS. 8, 8A and 8B having some aspects of its construction similar to the tool assembly of several previously described tool assemblies but with other differences. The sidewall 44 of the body 42 of the rotary actuator 40 of this embodiment has a first end body sidewall portion 44A which is cylindrical in cross-section and extends from the first body end 46 to a body mid-portion, and a second end body sidewall portion 44B which is non-cylindrical in cross-section and extends from the second body end 48 to the body mid-portion where the first and second end body sidewall portions are joined together. The interior sidewall surfaces of the first and second end body sidewall portions 44A and 44B are smooth. The piston head 96 of the piston sleeve 90 is disposed for reciprocation within only the non-cylindrical second end body sidewall portion 44B and has a perimeter with a shape corresponding to the non-cylindrical second end body sidewall portion so as to be in sliding engagement therewith, in this case an oval as shown in FIG. 8B. The sleeve portion 97 of the piston sleeve 90 is cylindrical in shape and has only outer helical splines 179 over a portion of its length.

The shaft 50 of the rotary actuator 40 in this seventh embodiment has an annular first end shaft portion 57 which is cylindrical in cross-section and extends from the shaft first end portion 53A toward the second body end 48 about the same length as the first end body sidewall portion 44A. The first end shaft portion 57 has a smooth exterior sidewall surface and is disposed in the smooth-walled, cylindrical first end body sidewall portion 44A for rotation therewithin. The first end shaft portion 57 further has an end wall 180 toward the first body end 46 and an annular sidewall 181 defining an interior chamber 182 with an open end 183 facing toward the second body end 48. The interior surface of the annular sidewall 181 has inner helical splines 185 which extend over a portion of its length. The sleeve portion 97 of the piston sleeve 90 extends within the interior chamber 182 of the first end shaft portion 57, and outer helical splines 179 of the piston sleeve 90 which mesh with inner helical splines 185 of the first end shaft portion 57.

The interior side of the end wall 180 has a first threaded recess 186 therein and a concentric second threaded recess 188, with the second threaded recess being located inward of the first threaded recess and having a larger diameter. The shaft 50 further includes a reduced diameter center shaft portion 59 having a threaded first end portion 190 which is threadably received in the second threaded recess 188 of the end wall 180, and a threaded second end portion 192 at the second body end 48 on which the shaft nut 54 is threadably attached. The center shaft portion 59 has an axially extending central aperture 194 which extends fully between the first end portion 190 and the second end portion 192 thereof. A center bolt 196 is disposed coaxially within the central aperture 194 of the center shaft portion 59, and has a threaded end portion 198 which is threadably received in the threaded first recess 186 of the end wall 180, and a head 200 which is sufficiently large to engage the annular outward end face of the second end portion 192 of the center shaft portion 59 at the second body end 48. Tightening of the center bolt 196 into the threaded first recess 186 applies an axial pre-stress/pre-load force to the shaft 50.

The piston sleeve 90 and the piston head 96 thereof has a circular center aperture through which the center shaft portion 59 extends.

The first and second attachment flanges 56 and 62 attached the tool attachment assembly 58 to the rotary actuator 40 much as described for the first embodiment of FIG. 2, except the bolts 53D attach the retainer member 60 to the shaft nut 54 rather than directly to the shaft 50.

With the arrangement of this seventh embodiment of FIGS. 8, 8A and 8B, when hydraulic fluid under pressure is selectively applied to the first port P1 or the second port P2, the piston head 96 will move longitudinally within the second end body sidewall portion 44B, but the matching non-cylindrical shapes of the piston head and the second end body sidewall portion prevent the rotation of the piston head. Linear reciprocation of the piston head 96 within the second end body sidewall portion 44B of the body 42 of the rotary actuator 40, with the outer helical splines 179 of the sleeve portion 90 engaging and meshing with the inner helical splines 185 of the first end shaft portion 57, causes rotation of the first end shaft portion 57 and the center shaft portion 59. The rotational movement of the first end shaft portion 57 and the center shaft portion 59 is transmitted to the tool attachment assembly 58 which results in lateral tilting of the bucket 34 or other tool attached thereto to the right or left.

While the non-cylindrical piston head 96 of the piston sleeve 90 and the non-cylindrical second end body sidewall portion 44B are only illustrated as being oval in cross-section, many other non-cylindrical shapes can be used for the piston head and second end body sidewall portion which allow linear sliding movement of the piston head within the second end body sidewall portion but yet limit rotational movement of the piston head within the second end body sidewall portion. These would include square, triangular and the like, and other non-cylindrical shapes. While matching cross-sectional shapes for the non-cylindrical piston head 96 of the piston sleeve 90 and the non-cylindrical second end body sidewall portion 44B are described, these shapes do not have to have the same cross-sectional shape just so the shapes for each selected prevent the rotation of the piston head within the second end body sidewall portion 44B as the piston head linearly reciprocates therein as the rotary actuator is operated under fluid power.

Figure 9:
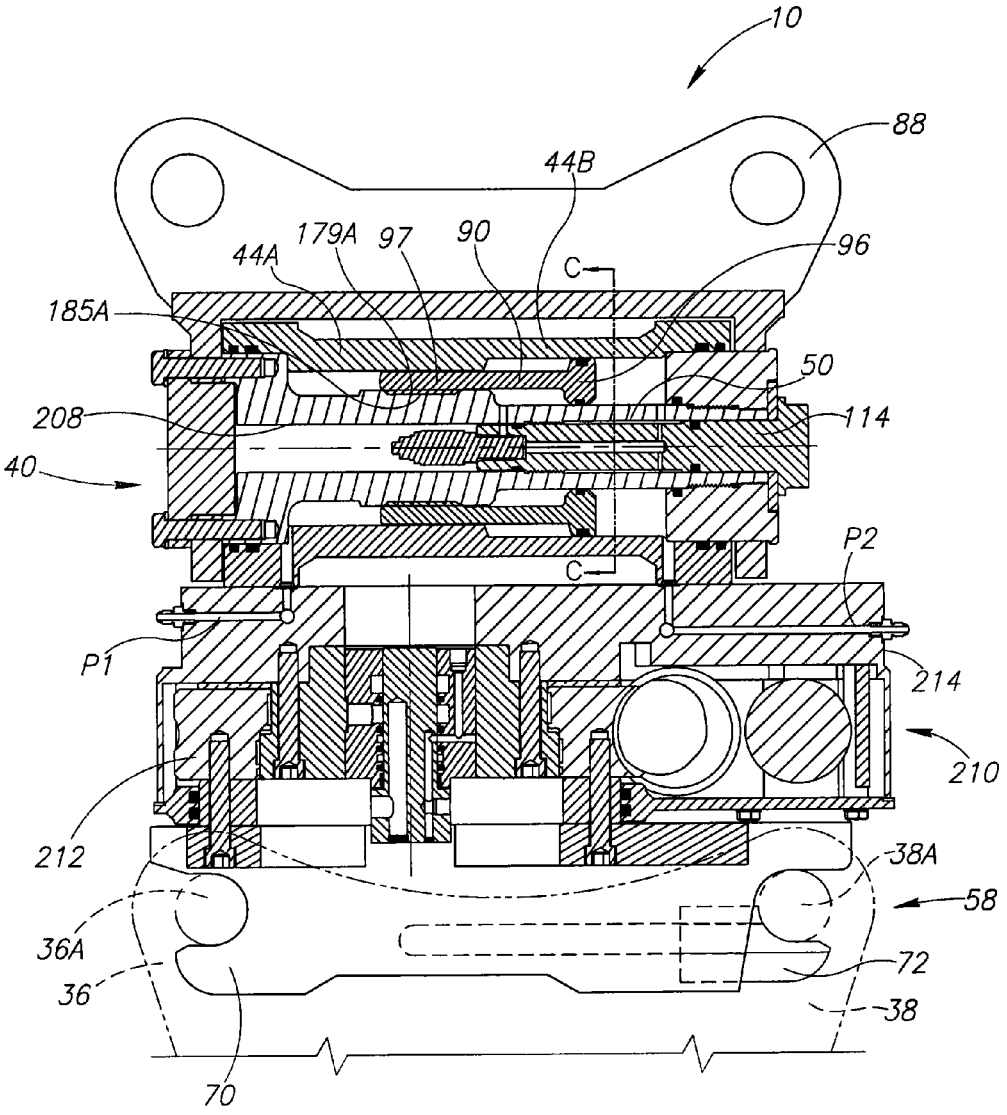
FIG. 9 is an enlarged, fragmentary, right side, cross-sectional view of a eighth embodiment of the tool assembly of FIG. 1 also providing rotation of a tool in addition to lateral tilting, shown taken substantially along the line B-B of FIG. 9A.
Figure 9B:
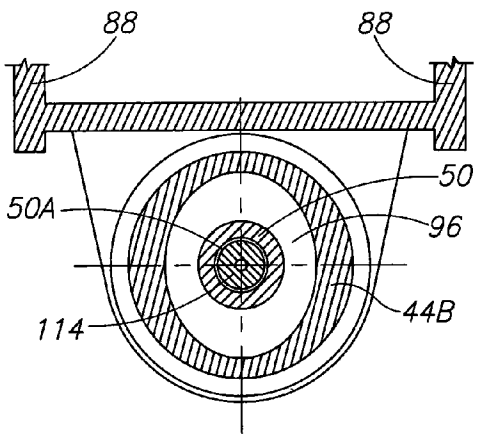
FIG. 9B is a partial cross-sectional view of the actuator of FIG. 9, shown taken substantially along the line C-C of FIG. 9.
Figure 9A:
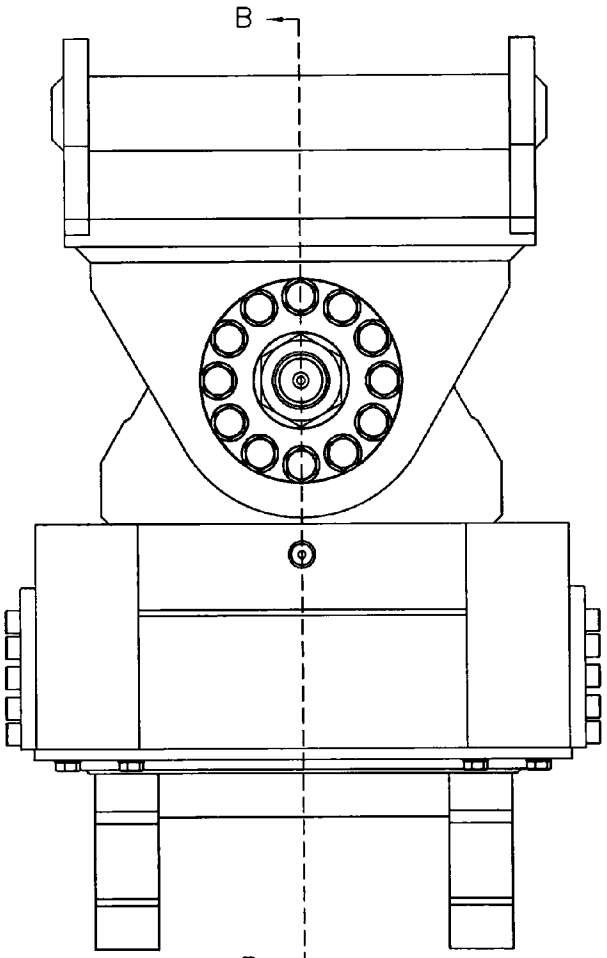
FIG. 9A is an end view of the tool assembly of FIG. 9.

An eighth embodiment of the fluid-powered, laterally tiltable tool assembly 10 is shown in FIGS. 9, 9A and 9B which also provides for rotation of the bucket 34 or other tool and well as lateral tilting thereof. Somewhat as in the third embodiment of FIG. 4, the shaft 50 of the rotary actuator 40 of this eighth embodiment has the axially extending central aperture 208 extending the full length of the shaft, and sized to receive the center bolt 114 therein to apply an axial pre-stress/pre-load force to the shaft 50. As in the fifth embodiment of FIG. 6, in this eighth embodiment the shaft 50 is held stationary relative to the attachment brackets 88 by which the tool assembly 10 is detachably connected to the second arm 20 and the rotation link 24 of the vehicle 12, and operation of the rotary actuator 40 causes the body 42 to rotate.

In this eighth embodiment, somewhat as with the seventh embodiment of FIGS. 8, 8A and 8B, the sidewall 44 of the body 42 of the rotary actuator 40 has a first end body sidewall portion 44A which is cylindrical in cross-section and extends from the first body end 46 to a body mid-portion, and a second end body sidewall portion 44B which extends from the second body end 48 to the body mid-portion with an interior sidewall which is non-circular in cross-sectional shape and an exterior sidewall which is circular in cross-sectional shape. The shape of the interior and exterior sidewalls of the second end body sidewall portion 44B are illustrated in FIG. 9B. The interior sidewall surfaces of the first and second end body sidewall portions 44A and 44B are smooth, and the piston head 96 of the piston sleeve 90 is disposed for reciprocation within only the second end body sidewall portion 44B and has a perimeter with a shape corresponding to the non-circular second end body sidewall portion so as to be in sliding engagement therewith, in this case an oval as shown in FIG. 9B. The piston head 96 has a circular center aperture through which the shaft 50 extends. The sleeve portion 97 of the piston sleeve 90 is cylindrical in shape and only has inner helical splines 179A over a portion of its length.

The shaft 50 of the rotary actuator 40 in this eighth embodiment is cylindrical in cross-section and extends through the piston sleeve 90 and the piston head 96 thereof. The exterior surface of the shaft 50 has outer helical splines 185A which extend over a portion of its length and mesh with the inner helical splines 179A of the piston sleeve 90.

With the arrangement of this eighth embodiment of FIGS. 9, 9A and 9B, when hydraulic fluid under pressure is selectively applied to the first port P1 or the second port P2, the piston head 96 will move longitudinally within the second end body sidewall portion 44B, but the matching non-circular shapes of the piston head and the second end body sidewall portion prevent the rotation of the piston head. Linear reciprocation of the piston head 96 within the second end body sidewall portion 44B of the body 42 of the rotary actuator 40, with the inner helical splines 179A of the sleeve portion 90 engaging and meshing with the outer helical splines 185A of the shaft 50, causes rotation of the shaft 50. The rotational movement of the shaft 50 is transmitted to the tool attachment assembly 58 which results in lateral tilting of the bucket 34 or other tool attached thereto to the right or left.

While the non-cylindrical piston head 96 of the piston sleeve 90 and the non-cylindrical second end body sidewall portion 44B are illustrated as being oval in cross-section, many other non-cylindrical shapes can be used for the piston head and second end body sidewall portion which allow linear sliding movement of the piston head within the second end body sidewall portion but yet limit rotational movement of the piston head within the second end body sidewall portion.

In this eighth embodiment, instead of the tool attachment assembly 58 being positioned immediately below and attached to the rotary actuator 40, the tool assembly 10 includes a turntable bearing assembly 210 positioned between the rotary actuator and the tool attachment assembly. The tool attachment assembly 58 is attached to the underside of the turntable bearing assembly 210 and moves therewith, including rotating with the turntable bearing assembly about an axis of rotation transverse to the axis of rotation of the rotary actuator 40 and being tilted laterally as the rotary actuator tilts the turntable bearing assembly laterally. With such an arrangement, the bucket 34 or other tool can be selectively laterally tilted about the axis of rotation of the rotary actuator 40, or selectively rotated about the axis of rotation of the turntable bearing assembly 210, or simultaneously both laterally tilted and rotated.

The turntable bearing assembly 210 includes a turntable bearing with a lower first member 212 to which the tool attachment assembly 58 is rigidly attached. The first turntable member 212 has teeth on its outer periphery for engaging a worm screw. An upper second turntable member 214 rotatably supports the first turntable member 212 therebelow and supports a hydraulic motor and worm screw such that the selective rotation of the hydraulic motor turns the worm screw which engages the teeth on the outer periphery of the first turntable member 212 to selectively rotate the first turntable member relative to the second turntable member 214 when the hydraulic motor is powered. This provides 360 degrees of continuous rotation. The second turntable member 214 is attached to the body 42 of the rotary actuator 40 for rotation therewith.

Figure 10:
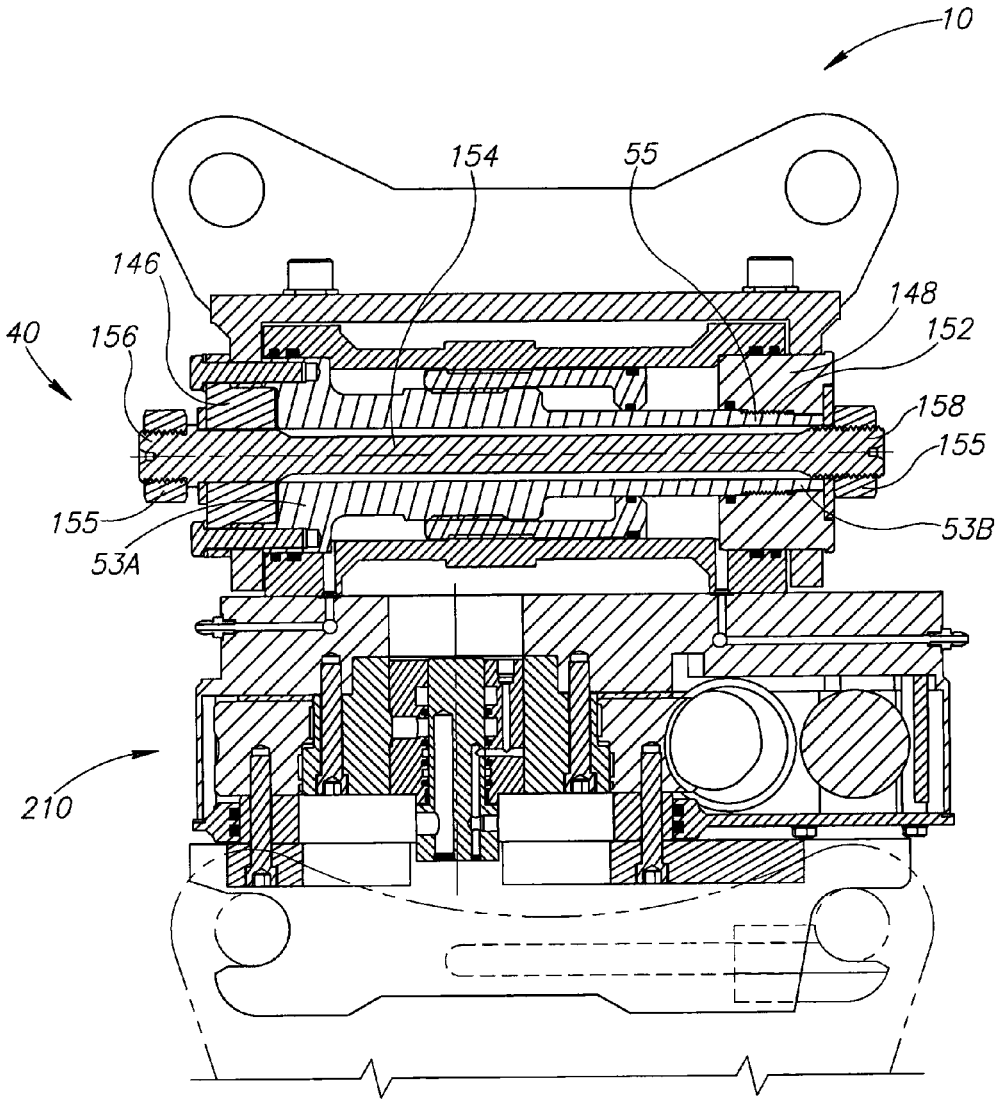
FIG. 10 is an enlarged, fragmentary, right side, cross-sectional view of a ninth embodiment of the tool assembly of FIG. 1 also providing rotation of a tool in addition to lateral tilting, shown taken substantially along the line A-A of FIG. 10A.
Figure 10A:
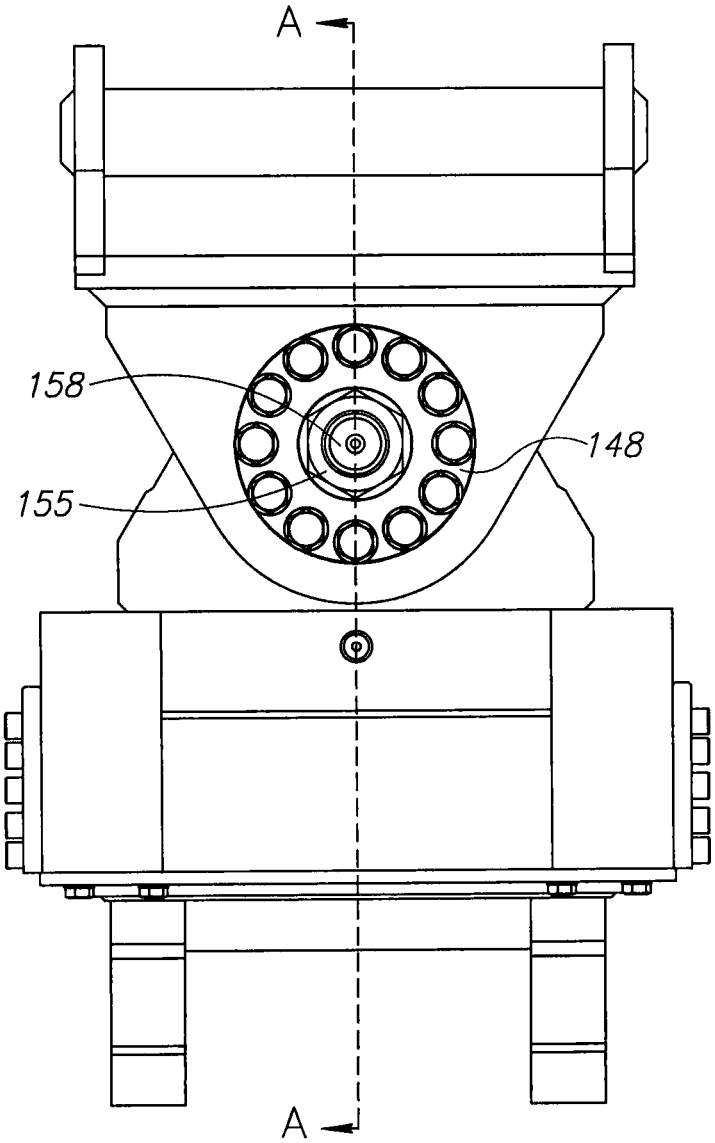
FIG. 10A is an end view of the tool assembly of FIG. 10.

A ninth embodiment of the fluid-powered, laterally tiltable tool assembly 10 is shown in FIGS. 10 and 10A which, as with the eighth embodiment provides for rotation of the bucket 34 or other tool as well as lateral tilting thereof. In this embodiment, a first end cap 146 is located at the first body end 46, and a second end cap 148 is located at the second body end 48 partially within the body 42. The first end cap 146 abuts the outward end face of the shaft first end portion 53A. The second end cap 148 has a threaded central aperture 152 which threadably receives a threaded portion 55 of the shaft 50. A tie rod 154 extends between and outward beyond the first and second end caps 146 and 148, and has a threaded first end portion 156 axially outward of the first end cap 146 and a threaded second end portion 158 axially outward of the second end cap 148. A nut 155 is threadably received on each of the threaded first and second end portions 156 and 158 of the tie rod 154. Tightening the nuts 155 on the threaded first and second end portions 156 and 158 of the tie rod 154 applies an axial pre-stress/pre-load force to shaft.

As with the eighth embodiment, the ninth embodiment of FIGS. 10 and 10A includes a turntable bearing assembly 210 positioned between the rotary actuator 40 and the tool attachment assembly 58, with the tool attachment assembly attached to the underside of the turntable bearing assembly 210 for movement therewith. As such, the tool attachment assembly 58 can be rotated by the turntable bearing assembly about an axis of rotation transverse to the axis of rotation of the rotary actuator 40 and tilted laterally as the rotary actuator tilts the turntable bearing assembly laterally. With such an arrangement, the bucket 34 or other tool can be selectively laterally tilted about the axis of rotation of the rotary actuator 40, or selectively rotated about the axis of rotation of the turntable bearing assembly 210, or simultaneously both laterally tilted and rotated.

Figure 11:
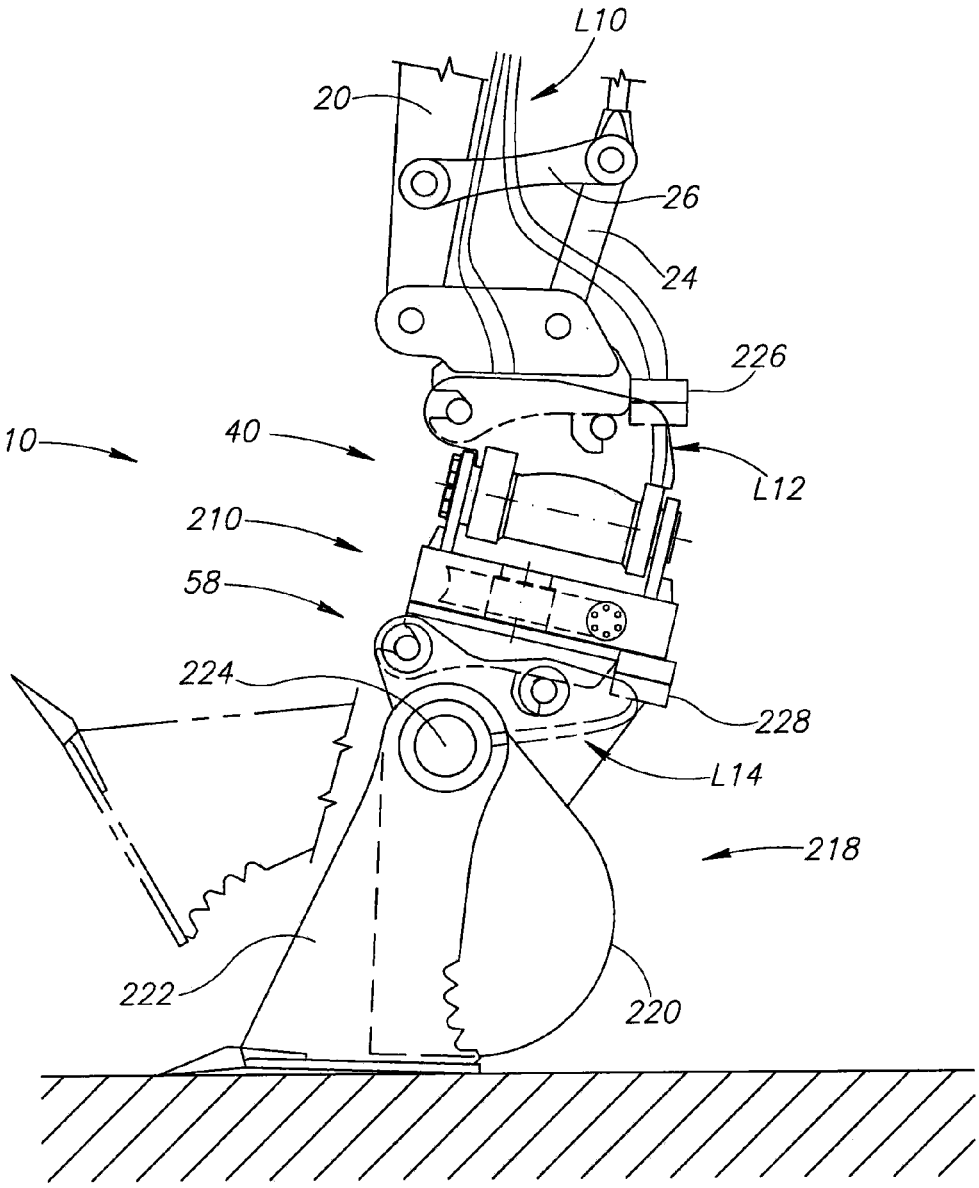
FIG. 11 is an enlarged, fragmentary, right side, cross-sectional view of a tenth embodiment of the tool assembly of FIG. 1 also providing rotation of a tool in addition to lateral tilting.

A tenth embodiment of the fluid-powered, laterally tiltable tool assembly 10 is shown in FIG. 11 which provides for rotation of a bucket or other tool as well as lateral tilting thereof. In this embodiment a hydraulically operated jaw bucket 218 is attached to and below the turntable bearing assembly 210. The rotary actuator 40 and the tool attachment assembly 58 used in the tenth embodiment may be of the construction used in embodiment 8 or embodiment 9, or any of the other previously described embodiments or variations thereof. Similarly, the construction of the turntable bearing assembly 210 may be as described for embodiments 8 and 9, or any other suitable construction. The jaw bucket 218 is of a construction much as described in U.S. Pat. No. 6,612,051 and includes a bucket portion 220 and a jaw portion 222, with the bucket portion supporting a jaw bucket rotary actuator 224 for pivotal movement if the jaw portion relative to the bucket portion. The body of the jaw bucket rotary actuator 224 is rigidly attached to the bucket portion 220 and the shaft of the jaw bucket rotary actuator is rigidly attached to the jaw portion 22, allowing the jaw portion to be selectively rotated relative to the bucket portion about a transverse axis of rotation.

In addition to the hydraulic fluid required to operate the rotary actuator 40, the tool attachment assembly 58 and the turntable bearing assembly 210, hydraulic fluid must be supplied to the jaw bucket rotary actuator 224. A plurality of hydraulic lines L10 extending along the second arm 20 of the vehicle 12 supply the hydraulic fluid to tool assembly 10 of FIG. 11. Several of the hydraulic lines L10 terminate at a first member of a conventional automatic first oil line quick connect 226. Another plurality of hydraulic lines L12 extend from a second member of the first oil line quick connect 226 which is separable from the first member thereof and when connected to the first member each of the hydraulic lines L12 is in fluid communication with one of the hydraulic lines L10. The first oil line quick connect 226 allows for remote connection and disconnection of the first and second members thereof automatically as the tool assembly 10 is connected and disconnected from the second arm 20 and rotation link 24 of the vehicle 12. Some of the hydraulic lines L12 supply hydraulic fluid to the ports of the rotary actuator 40, the tool attachment assembly 58 and the turntable bearing assembly 210, in one of the manners described herein or a suitable alternative manner. A pair of the hydraulic lines L12 extend to the jaw bucket 218 for controlling the jaw bucket rotary actuator 224, and terminate at a first member of a conventional automatic second oil line quick connect 228. A pair of hydraulic lines L14 extend from a second member of the second oil line quick connect 228 which is separable from the first member thereof and when connected to the first member each of the hydraulic lines L14 is in fluid communication with one of the pair of hydraulic lines L12 for controlling the jaw bucket rotary actuator 224. The second oil line quick connect 228 allows for remote connection and disconnection of the jaw bucket 218 or another tool automatically as the jaw bucket or other tool assembly is connected and disconnected from the tool attachment assembly 58.

Figure 12:
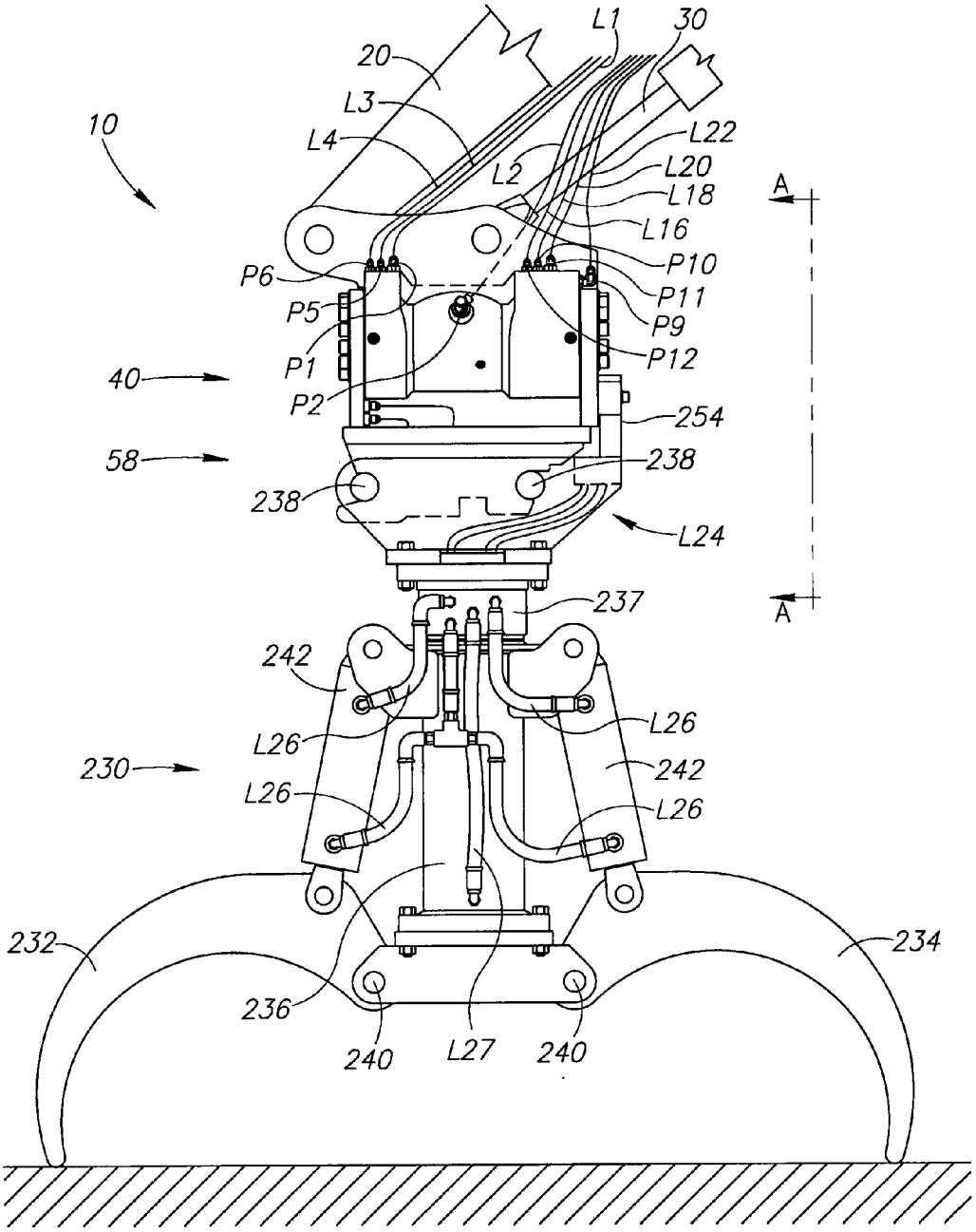
FIG. 12 is an enlarged, fragmentary, right side, cross-sectional view of an eleventh embodiment of the tool assembly of FIG. 1 with a rotatable grapple assembly attached.
Figure 12A:
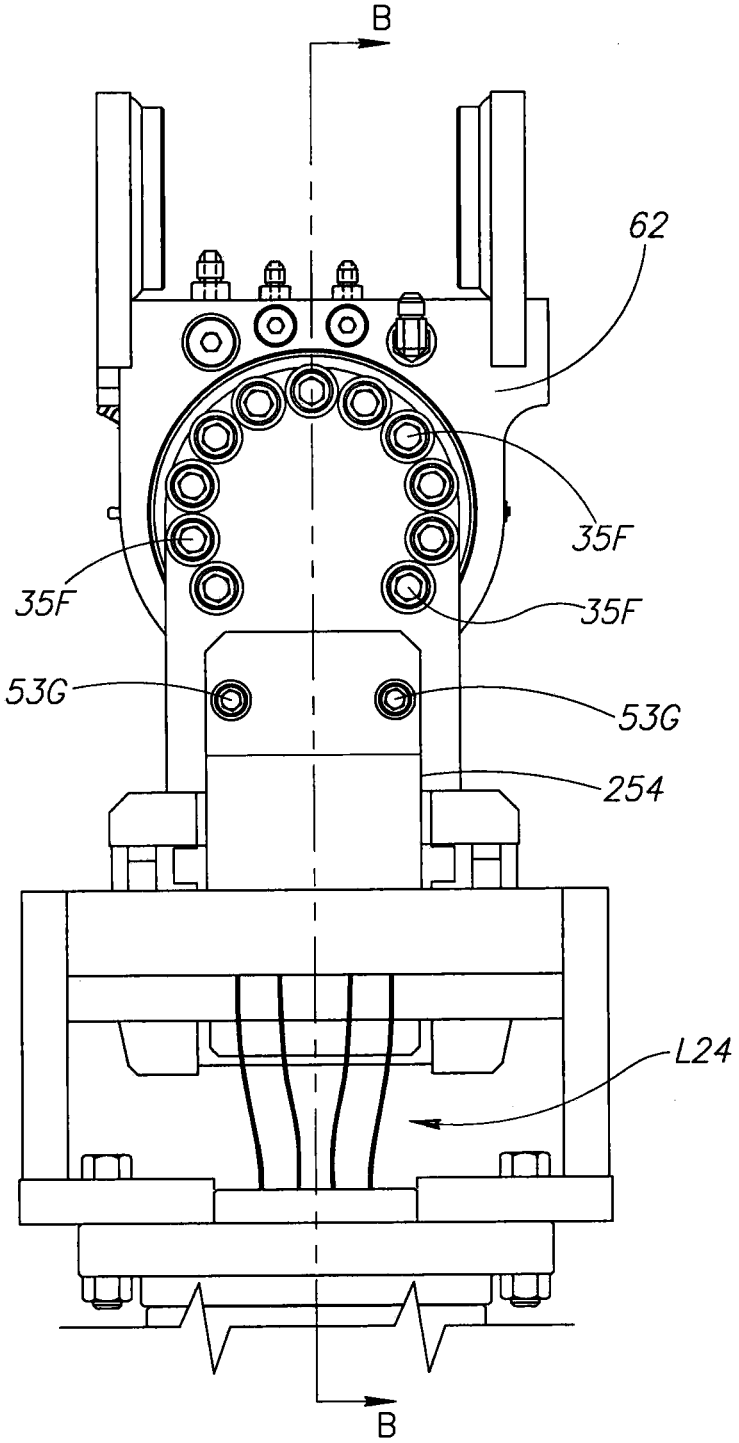
FIG. 12A is a reduced, partial end view taken substantially along the line A-A of FIG. 12.
Figure 12B:
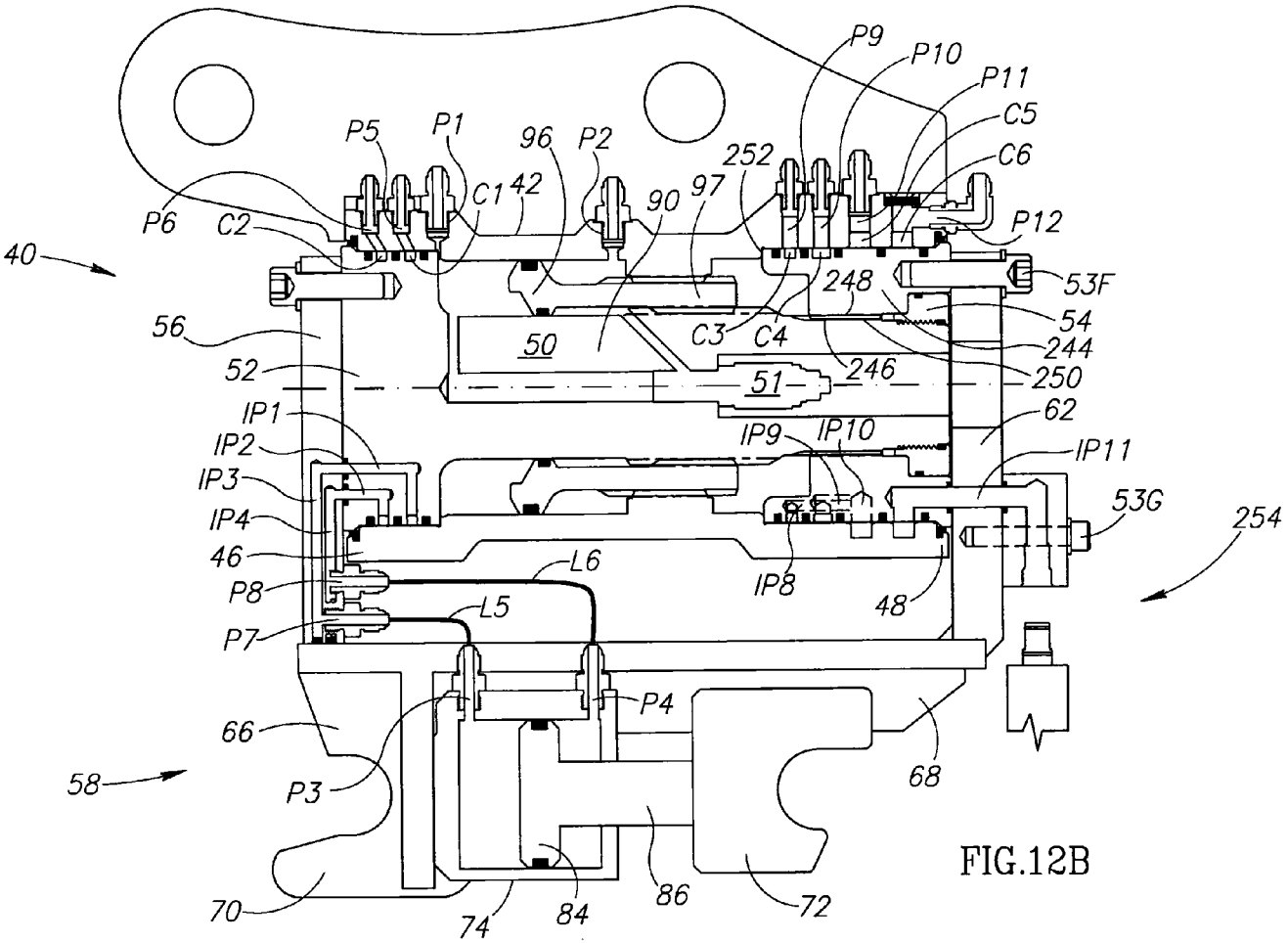
FIG. 12B is an enlarged cross-sectional view taken substantially along the line B-B of FIG. 12 without the grapple assembly attached.

An eleventh embodiment of the fluid-powered, laterally tiltable tool assembly 10 is shown in FIGS. 12, 12A and 12B. The rotary actuator 40 and the tool attachment assembly 58 used in this eleventh embodiment are very similar to those of the embodiment of FIG. 2. Shown attached to and below the tool attachment assembly 58 is a rotatable grapple assembly 230 having a first grapple member 232 and an opposing second grapple member 234. The grapple assembly 230 includes a grapple rotary actuator 236 with an elongated body having at a longitudinal upper end thereof a shaft end flange 237 projecting upward beyond the end of the body. A pair of clevis pins 238, much like the pins 36A and 38A of the first and second clevises 36 and 38 of the conventional bucket 34 described above, are attached to the shaft end flange 237 and provide for releasable attachment of the grapple assembly 230 to the tool attachment assembly 58 as described above for buckets and other tools. The longitudinal lower end of the elongated body of the grapple rotary actuator 236 has the first and second grapple members 232 and 234 rotatably attached thereto, each by a pivot pin 240. Each of the first and second grapple members 232 and 234 has an extendable hydraulic cylinder 242 extending between the grapple member and the body of the grapple rotary actuator for selective rotation of the grapple member about its pivot pin 240 such that the first and second grapple members may be rotated between a fully open position as shown in FIG. 12, and a full closed position with the distal tips of the first and second grapple members moved together. Hydraulic fluid supplied to the grapple rotary actuator 236 results in relative rotation between the body and shaft of the grapple rotary actuator, and hence rotation of the first and second grapple members 232 and 234 pivotally attached to the body about a longitudinal axis of the grapple rotary actuator.

Operation of the rotary actuator 40 of the tool assembly 10 produces lateral tilting of the grapple assembly 230, operation of the grapple rotary actuator 236 produces rotational movement of the first and second grapple members 232 and 234 about the grapple rotary actuator longitudinal axis, and operation of the hydraulic cylinders 242 produces relative movement between the first and second grapple members 232 and 234. This requires hydraulic fluid be supplied to the rotary actuator 40, the tool attachment assembly 58, grapple rotary actuator 236 and the hydraulic cylinders 242, as well as hydraulic fluid to the tool attachment assembly 58 to release and attach the grapple assembly 230 to the tool attachment assembly.

Fluid is supplied to the tool attachment assembly 58 much as with the embodiment of FIG. 2, with fluid communication between the first and second circumferential channels C1 and C2 and the third and fourth ports P3 and P4 of the linear actuator 74 accomplished by first and second internal passageways IP1 and IP2 in the shaft flange portion 52, and third and fourth internal passageways IP3 and IP4 in the first attachment flange 56. However, as best illustrated in FIG. 12B, in the eleventh embodiment of the tool assembly 10, the third and fourth internal passageways IP3 and IP4 communicate with seventh port P7 and eighth port P8, respectively. A hydraulic line L5 extends between the seventh port P7 and the third port P3 of the linear actuator 74 of the tool attachment assembly 58, and a hydraulic line L6 extends between the eighth port P8 and the fourth port P4 of the linear actuator of the tool attachment assembly.

To supply fluid to the grapple assembly 230, the rotary actuator 40 of this eleventh embodiment includes an annular oil gland member 244 mounted coaxially within the body 42 at the second body end 48 for rotation with the shaft 50 which extends through a central aperture 246 of the oil gland member. The central aperture 246 of the oil gland member 244 has inner straight splines 248 which mesh with outer straight splines 250 of an end portion of the shaft 50. The oil gland member 244 is held in axial position within the body 42 between an inner shoulder 252 of the body sidewall 44 and the shaft nut 54. In this eleventh embodiment the second attachment flange 62 is bolted directly to the oil gland member 244 by a plurality of circumferentially arranged bolts 53F.

Fluid to control the operation of the grapple rotary actuator 236 to rotate the grapple assembly 230 clockwise is supplied by a hydraulic line L16 to a ninth port P9 in the body sidewall 14 at the location of the oil gland member 244, and to rotate the grapple assembly counterclockwise is supplied by a hydraulic line L18 to a tenth port P10 in the body sidewall at the location of the oil gland member. Fluid to control the operation of the hydraulic cylinders 242 to close the first and second grapple members 232 and 234 is supplied by a hydraulic line L20 to an eleventh port P11 in the body sidewall 14 at the location of the oil gland member 244, and to open the first and second grapple members is supplied by a hydraulic line L22 to a twelfth port P12 in the body sidewall at the location of the oil gland member.

The periphery of the oil gland member 244, at locations radially inward from the ninth and tenth ports P9 and P10, has third and fourth circumferential channels C3 and C4, which are in fluid communication with the ninth and tenth ports, respectively, as shown in FIG. 12B. The interior wall of the sidewall 44 of the body 42, at locations radially inward from the eleventh and twelfth ports P11 and P12, has fifth and sixth circumferential channels C5 and C6, which are in fluid communication with the eleventh and twelfth ports.

Fluid communication between the third, fourth, fifth and sixth circumferential channels C3, C4, C5 and C6 and the grapple rotary actuator 236 and the hydraulic cylinders 242 is accomplished by internal passageways and hydraulic lines. The third, fourth, fifth and sixth circumferential channels C3, C4, C5 and C6 are in communication with eighth, ninth, tenth and eleventh internal passageways IP8, IP9, IP10 and IP11 in the oil gland member 244 at a location toward a lower side of the shaft 50 of the rotary actuator 40. The eighth, ninth, tenth and eleventh internal passageways IP8, IP9, IP10 and IP11 communicate through the second attachment flange 62 with a first member of a conventional automatic third oil line quick connect 254. The first member is bolted to the second attachment flange 62 with bolt 53G. A plurality of hydraulic lines L24 (see FIG. 12) extend from a second member of the third oil line quick connect 254 which is separable from the first member thereof and when connected to the first member each of the eighth, ninth, tenth and eleventh internal passageways IP8, IP9, IP10 and IP11 is in fluid communication with one of the hydraulic lines L24 which extend to the grapple assembly 230. The hydraulic lines L24 communicating fluid to the hydraulic cylinders 242 are connected to a corresponding one of the hydraulic lines L26. One of the hydraulic lines L24 communicating fluid to the grapple rotary actuator 236 is connected to a hydraulic line L27. Table 1 forming a part of FIG. 12 outlines the fluid connections using reference numerals in circles to identify the various ports and lines shown in FIG. 12 which control clockwise and counterclockwise rotation of the rotary actuator 40 to tilt the tool assembly of FIG. 12, retraction and extension of the linear actuator 74 of the tool attachment assembly 58, clockwise and counterclockwise rotation of the grapple rotary actuator 236 of the grapple assembly 230, and extension and retraction of the hydraulic cylinders 242 to close and open the first and second grapple members 232 and 234 of the grapple assembly 230. The third oil line quick connect 254 allows for remote connection and disconnection of the first and second members thereof automatically as the grapple assembly 230 or another tool is connected and disconnected from the tool attachment assembly 58.

Figure 13:
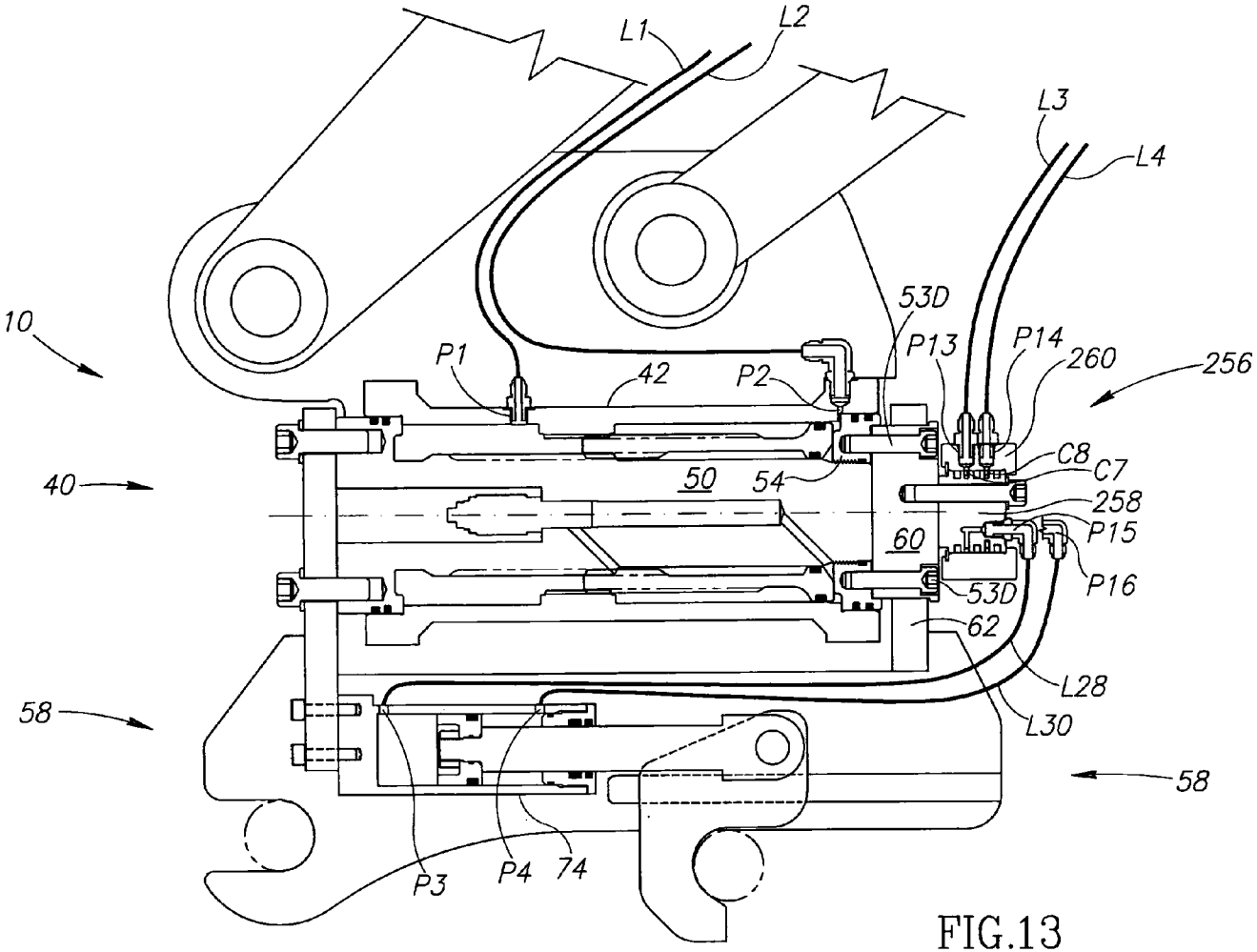
FIG. 13 is an enlarged, fragmentary, right side, cross-sectional view of a twelfth embodiment of the tool assembly of FIG. 1.

A twelfth embodiment of the fluid-powered, laterally tiltable tool assembly 10 is shown in FIG. 13 with the rotary actuator 40 similar to that of the embodiment of FIG. 2. In this embodiment a rotary oil gland 256 is externally mounted to the retainer member 60. The oil gland 256 has a cylindrical inner member 258 which is securely bolted to the retainer member 60 for rotation with the shaft 50 by bolt 53H, and an annular outer member 260 which is rotatably mounted to the inner member 258. The hydraulic lines L3 and L4 which supply fluid to the third and fourth ports P3 and P4, respectively, of the linear actuator 74 of the tool attachment assembly 58 are connected to a thirteenth port P13 and a fourteenth port P14 in the outer member 260 of the oil gland 256. The periphery of the inner member 258, at a location radially inward from the thirteenth and fourteenth ports P13 and P14, has seventh and eighth circumferential channels C7 and C8 which are in fluid communication with fifteenth and sixteenth ports P15 and P16, respectively, of the axially outward face of the inner member. A hydraulic line L28 connects the fifteenth port P15 to the third port P3 of the linear actuator 74, and a hydraulic line L30 connects the sixteenth port P16 to the fourth port P4 of the linear actuator.

Figure 14:
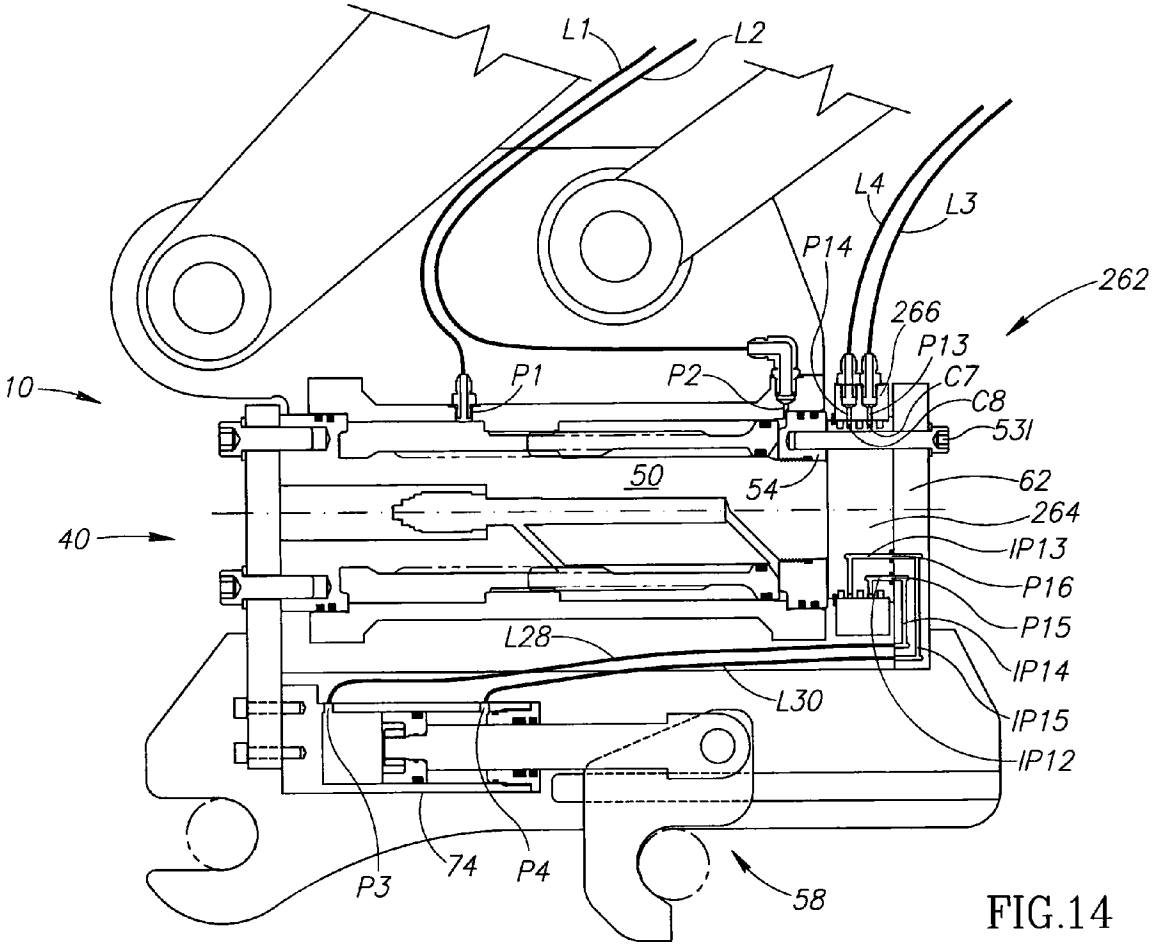
FIG. 14 is an enlarged, fragmentary, right side, cross-sectional view of a thirteenth embodiment of the tool assembly of FIG. 1.

A thirteenth embodiment of the fluid-powered, laterally tiltable tool assembly 10 is shown in FIG. 14 with the rotary actuator 40 similar to that of the embodiment of FIG. 2. Again, in embodiment a rotary oil gland 262 is externally mounted although in position between the second attachment flange 62 and the shaft nut 54. The oil gland 262 has a cylindrical inner member 264 which is held in place for rotation with the shaft 50 by bolts 53I which extend through the second attachment flange 62 and the inner member 264, and are threadably received by the shaft nut 54. The hydraulic lines L3 and L4 which supply fluid to the third and fourth ports P3 and P4, respectively, of the linear actuator 74 of the tool attachment assembly 58 are connected respectively to a thirteenth port P13 and a fourteenth port P14 in the outer member 266 of the oil gland 262. The periphery of the inner member 264, at a location radially inward from the thirteenth and fourteenth ports P13 and P14, has seventh and eighth circumferential channels C7 and C8 which are in fluid communication with fifteenth and sixteenth ports P15 and P16, respectively, of the axially outward face of the inner member via twelfth and thirteenth internal passageways IP12 and IP13, respectively, of the inner member 264 of the oil gland 262. The twelfth and thirteenth internal passageways IP12 and IP13 communicate with fourteenth and fifteenth internal passageways IP14 and IP15 of the second attachment flange 62, respectively. The hydraulic line L28 connects the fourteenth internal passageway IP14 to the third port P3 of the linear actuator 74, and the hydraulic line L30 connects the fifteenth internal passageway IP15 to the fourth port P4 of the linear actuator.

Figure 15:
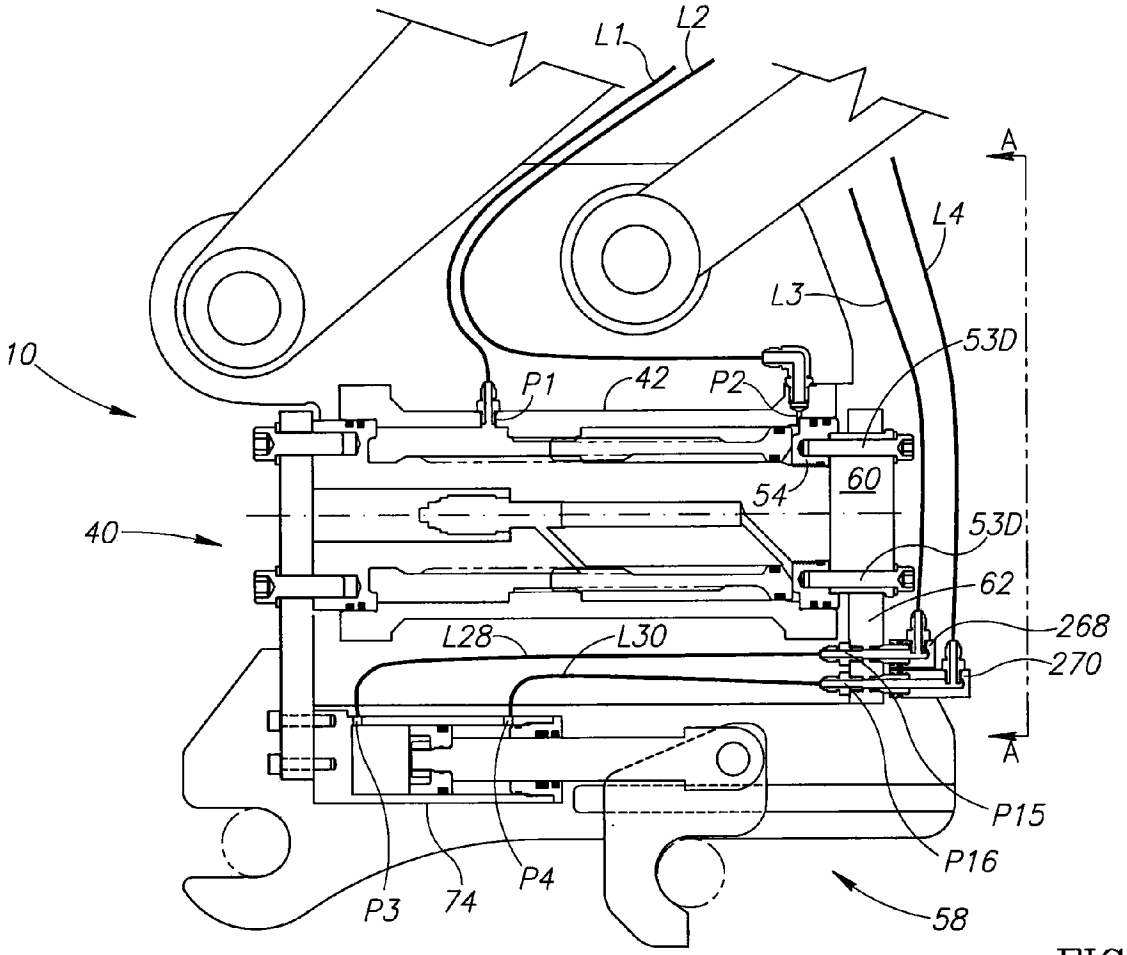
FIG. 15 is an enlarged, fragmentary, right side, cross-sectional view of a fourteenth embodiment of the tool assembly of FIG. 1.
Figure 15A:
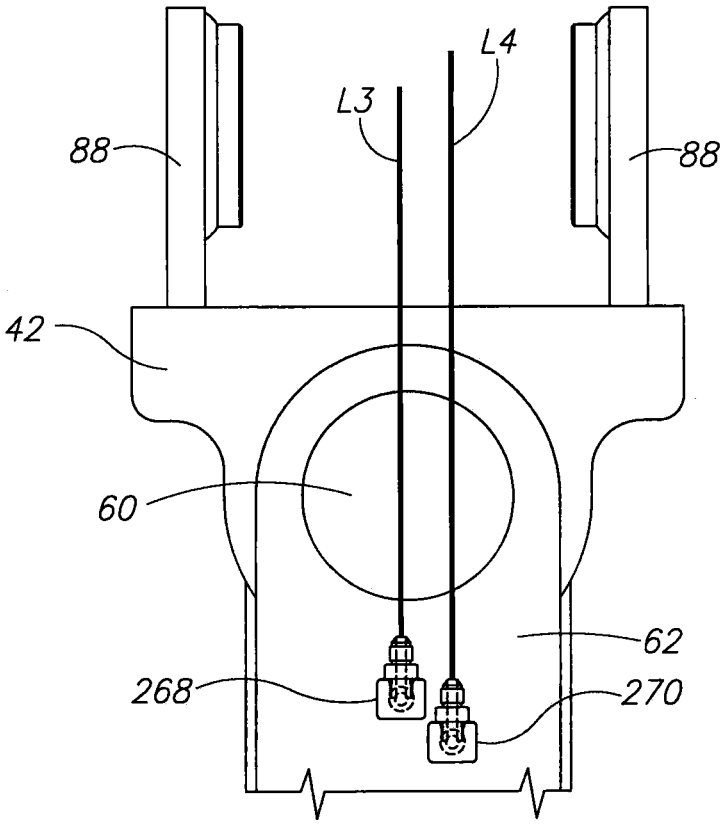
FIG. 15A is a partial end view taken substantially along the line A-A of FIG. 15.

A fourteenth embodiment of the fluid-powered, laterally tiltable tool assembly 10 is shown in FIGS. 15 and 15A with the rotary actuator 40 similar to that of the twelfth embodiment of FIG. 13. However, in this embodiment, two rotary oil gland 268 and 270 are non-coaxially, externally mounted to the axially outward face of the second attachment flange 62 retainer member 60. The hydraulic lines L3 and L4 which supply fluid to the third and fourth ports P3 and P4, respectively, of the linear actuator 74 of the tool attachment assembly 58 are connected to the oil glands 268 and 270, respectively, which communicate with the fifteenth and sixteenth ports P15 and P16 which pass fully between the outward face and the inward face of the second attachment flange 62 at adjacent locations below the body 42 of the rotary actuator 40. The hydraulic line L28 connects the fifteenth port P15 to the third port P3 of the linear actuator 74, and the hydraulic line L30 connects the sixteenth port P16 to the fourth port P4 of the linear actuator.

Figure 16:
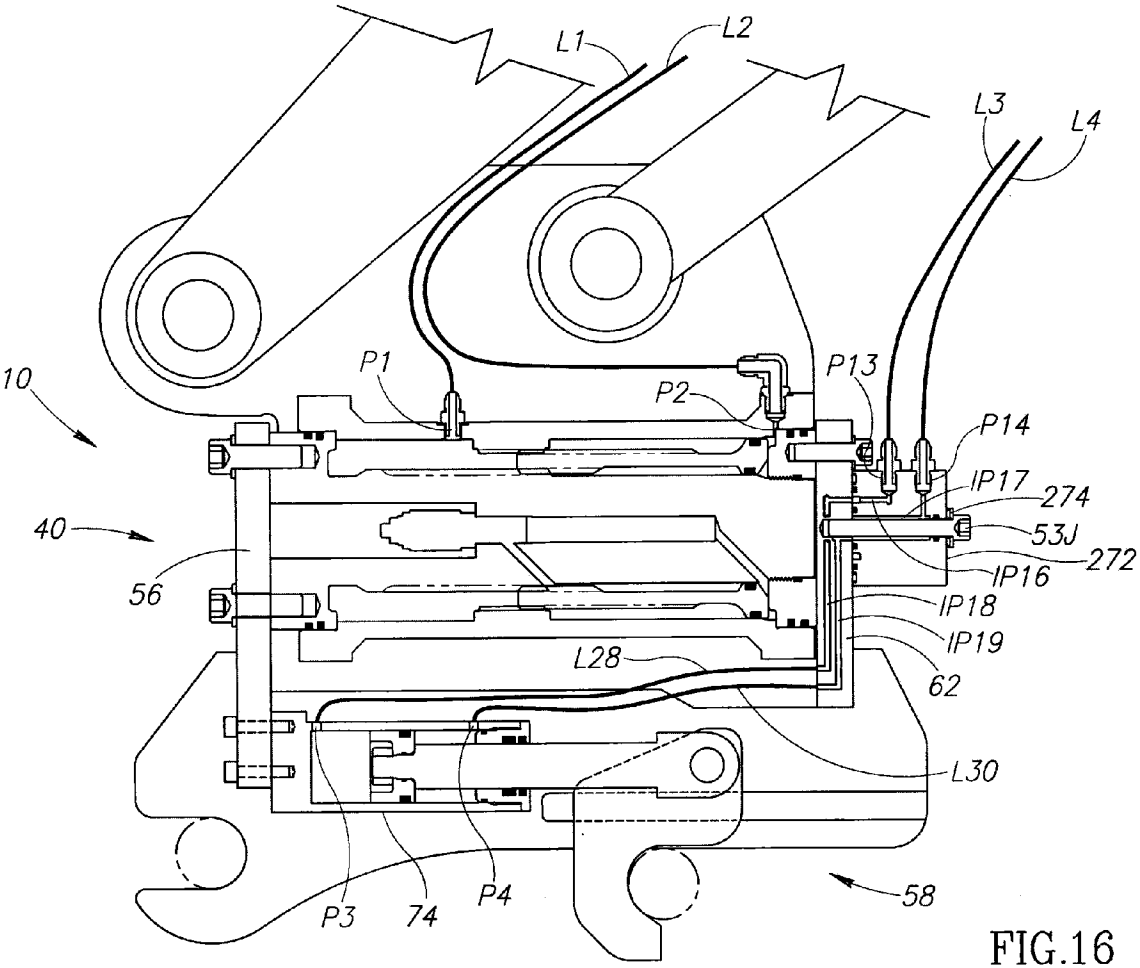
FIG. 16 is an enlarged, fragmentary, right side, cross-sectional view of a fifteenth embodiment of the tool assembly of FIG. 1.

A fifteenth embodiment of the fluid-powered, laterally tiltable tool assembly 10 is shown in FIG. 16 with the rotary actuator 40 similar to that of the embodiment of FIG. 2. In this embodiment a rotary oil gland member 272 is externally mounted to the axially outward face of the second attachment member 62, in coaxial arrangement with the shaft 50, by a bolt 53J which is also coaxial with the shaft. A bearing 274 is positioned between the head of the bolt 53J and the axially outward face of the oil gland member 272 so that while the oil gland member is held firmly against the axially outward face of the second attachment member 62 its is able to rotate relative to the second attachment member as the shaft 50 rotates the second attachment member. The hydraulic lines L3 and L4 which supply fluid to the third and fourth ports P3 and P4, respectively, of the linear actuator 74 of the tool attachment assembly 58 are connected to the thirteenth port P13 and the fourteenth port P14 in the sidewall of the oil gland member 272. A sixteenth internal passageway IP16 extends between the thirteenth port P13 and the axially inward face of the oil gland member 272, and a seventeenth internal passageway IP17 extends between the fourteenth port P14 and the axially inward face of the oil gland member. The sixteenth internal passageway IP16 communicates with an eighteenth internal passageway IP18 in the second attachment member 62, which in turn communicates with the hydraulic line L28 connected to the third port P3 of the linear actuator 74. The seventeenth internal passageway IP17 communicates with a nineteenth internal passageway IP19 in the second attachment member 62, which in turn communicates with the hydraulic line L30 connected to the fourth port P4 of the linear actuator 74. Seals are provided between the axially outward face of the second attachment member 62 and the axially inward face of the oil gland member 272 to prevent fluid leakage.

Figure 17:
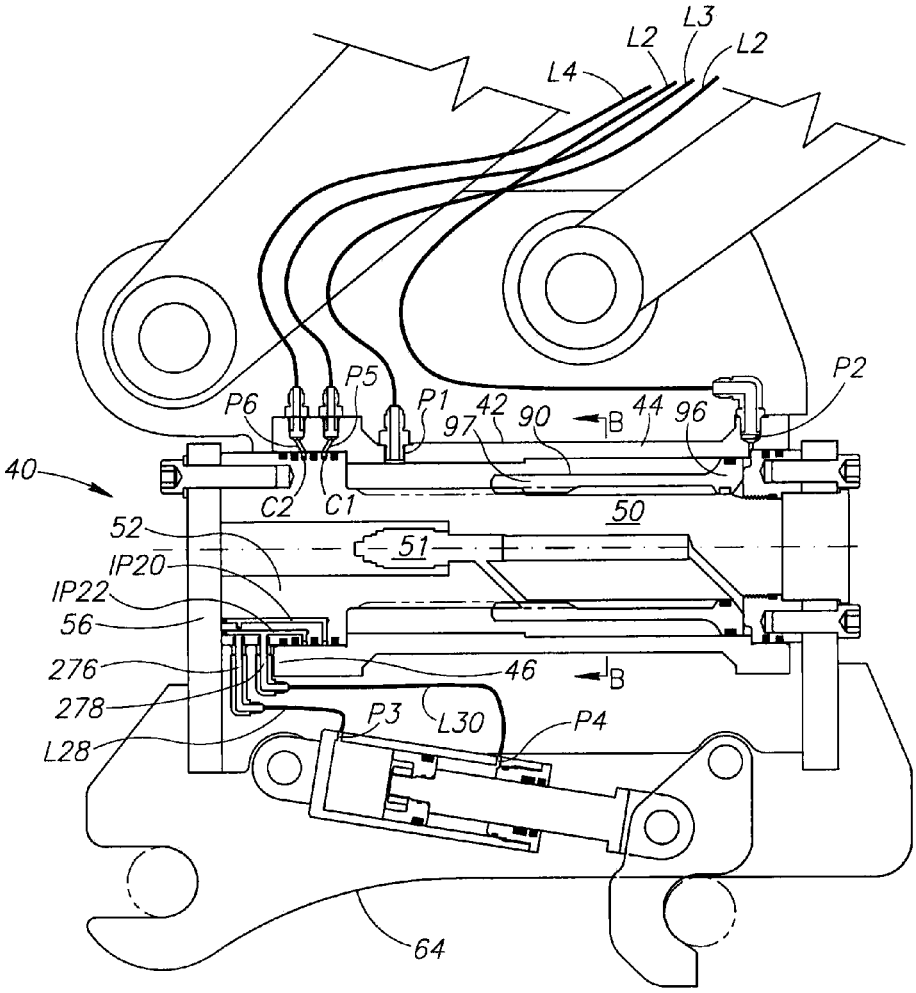
FIG. 17 is an enlarged, fragmentary, right side, cross-sectional view of a sixteenth embodiment of the tool assembly of FIG. 1.
Figure 17A:
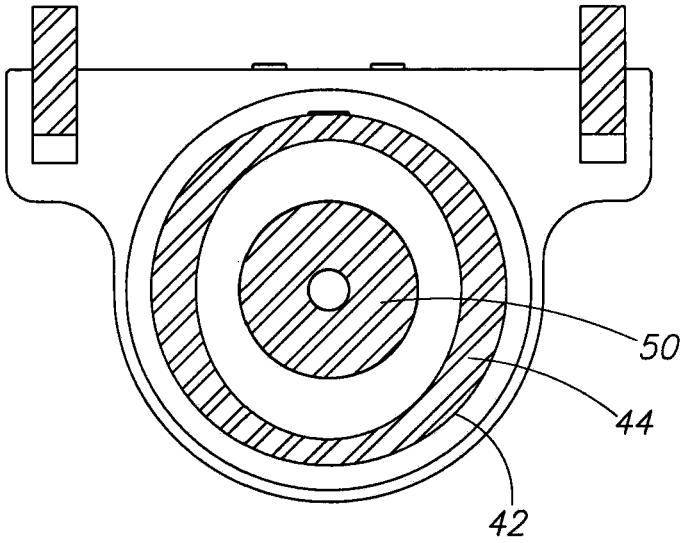
FIG. 17A is a partial cross-sectional view taken substantially along the line B-B of FIG. 17.

A sixteenth embodiment of the fluid-powered, laterally tiltable tool assembly 10 is shown in FIGS. 17 and 17A with the rotary actuator 40 similar to that of the embodiment of FIG. 2. Much as with the embodiment of FIG. 2, internal passageways are used to communicate the fluid supplied by the hydraulic lines L3 and L4 to the third and fourth ports P3 and P4 of the linear actuator 74 of the tool attachment assembly 58; however, in this sixteenth embodiment the internal passageways are not located in the first attachment flange 56. In particular, the periphery of the shaft flange portion 52 of the shaft 50 of the rotary actuator 40, at a location radially inward from the fifth port P5, has the first circumferential channel C1 which is in fluid communication with the fifth port P5. Similarly, periphery of the shaft flange portion 52 of the shaft 50 of the rotary actuator 40, at a location radially inward from the sixth port P6, has the second circumferential channel C2 which is in fluid communication with the sixth port P6.

Fluid communication between the first and second circumferential channels C1 and C2 and the third and fourth ports P3 and P4 of the linear actuator 74 is accomplished by twentieth and twenty-second internal passageways IP20 and IP22 in the shaft flange portion 52 of the shaft 50 which communicate with fittings 276 and 278, respectively, in the portion sidewall of the shaft flange portion 52 which extends rearwardly beyond the first body end 46 of the body 42 of the rotary actuator 40 at a location toward a lower side of the shaft. The hydraulic line L28 connects the fitting 276 to the third port P3 of the linear actuator 74 of the tool attachment assembly 58, and the hydraulic line L30 connects the fitting 278 to the fourth port P4 of the linear actuator.

The piston sleeve 90 of this sixteenth embodiment uses an oval piston head 96 and a matching oval body sidewall 44 (the sidewall being shown in cross-section in FIG. 17A). As such, the piston sleeve 90 does not use outer splines for meshing with the inner splines of the body sidewall 44 to prevent rotation therebetween as the piston head 96 reciprocates within the body 42 when the rotary actuator 40 is operated, since engagement of the non-circular in cross-sectional shape of the piston head 96 of the piston sleeve 90 with the similarly shaped non-circular in cross-sectional interior sidewall surface of the body sidewall 44 prevents the rotation of the piston sleeve relative to the body. While the non-cylindrical piston head 96 of the piston sleeve 90 and the non-cylindrical body sidewall 44 are illustrated as being oval in cross-section, many other non-cylindrical shapes can be used for the piston head and body sidewall portion which allow linear sliding movement of the piston head within the body sidewall but yet limit rotational movement of the piston head within the body sidewall.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A fluid-powered tool actuator connectable to a source of pressurized fluid remote from the tool actuator and usable with a vehicle having an arm and a rotation link associated therewith for rotation of the tool actuator in a first plane defined by movement of the rotation link relative to the arm, each of the arm and rotation link having an attachment member located toward a free end thereof, and usable with a tool having a first tool attachment member and a second tool attachment member spaced away from the first tool attachment member, the tool actuator comprising:

a body having a longitudinal axis and first and second body ends;

a first wall portion movable with said body;

a second wall portion movable with said body;

a shaft rotatably disposed within said body in general coaxial arrangement with said body for rotation of said shaft and said body relative to each other with one of said shaft and said body being a stationary member and the other of said shaft and said body being a rotatable member;

a third wall portion movable with said shaft;

a fourth wall portion movable with said shaft, said first wall portion and said third wall portion having a first circumferentially extending fluid distribution channel located therebetween, and said second wall portion and said fourth wall portion having a second circumferentially extending fluid distribution channel located therebetween;

first, second, third and fourth fluid ports for operation of the tool actuator in response to the selective application of pressurized fluid thereto from the source of pressurized fluid, said first fluid port in fluid communication with said first fluid distribution channel and remaining in fluid communication therewith as said rotatable member rotates relative to said stationary member, and said second fluid port in fluid communication with said second fluid distribution channel and remaining in fluid communication therewith as said rotatable member rotates relative to said stationary member;

a linear-to-rotary torque transmitting member mounted for longitudinal movement within said body in response to selective application of pressurized fluid to said third fluid port and said fourth fluid port from the source of pressurized fluid, said torque-transmitting member engaging said body and said shaft to translate longitudinal movement of said torque-transmitting member into clockwise and counterclockwise relative rotational movement of said shaft and said body;

an attachment bracket attached to said stationary member and having a first attachment member located generally along said body axis for pivotal attachment to the vehicle arm by the arm attachment member and a second attachment member located generally along said body axis away from said first attachment member for pivotal attachment to the rotation link by the rotation link attachment member, said first and second attachment members being selectively detachable from the arm and rotation link attachment members, wherein with said first and second attachment members attached to the arm and rotation link attachment members, movement of the rotation link causes said stationary member to rotate about the vehicle arm with movement of said longitudinal axis of said body in generally parallel alignment with the first plane, and wherein the tool actuator is selectively detachable from the vehicle arm and rotation link;

a support frame attached to said rotatable member and positioned laterally outward beyond said body;

a third attachment member attached to said support frame and located for releasable attachment to the first tool attachment member;

a fourth attachment member movably attached to said support frame for movement relative to said third attachment member for releasable attachment to the second tool attachment member, said third and fourth attachment members being attachable to the tool for rotation of the tool with said rotatable member through a second plane extending laterally, generally transverse to the first plane; and an actuator attached to said support frame, said actuator having a fifth fluid port in fluid communication with said first fluid distribution channel and a sixth fluid port in fluid communication with said second fluid distribution channel for operation of said actuator in response to the selective application of pressurized fluid to said first and second fluid ports from the source of pressurized fluid, said actuator having a member attached to said fourth attachment member for selectively moving said fourth attachment member in response to the selective application of pressurized fluid to said first and second fluid ports to permit connection and disconnection of said third and fourth attachment members to and from the first and second tool attachment members, whereby the tool attached to the tool actuator is rotatable in the first plane and laterally tiltable in the second plane in response to rotation of said rotatable member.

2. The tool actuator of claim 1 wherein said actuator is a linear actuator and said member is an extendable member.

3. The tool actuator of claim 1 wherein said shaft is said rotatable member and said body is said stationary member, and said body is rigidly attached to said attachment bracket, further including:

first and second fluid passageways with said first fluid passageway in fluid communication with said first fluid distribution channel and with said second fluid passageway in fluid communication with said second fluid distribution channel;

a fifth attachment member attached to said first shaft end portion for movement therewith and extending laterally outward and attached to said support frame for rotation of said support frame with said shaft;

a sixth attachment member attached to said second shaft end portion for movement therewith and extending laterally outward and attached to said support frame for rotation of said support frame with said shaft; and third and fourth fluid passageways, each located interior of one or the other of said fifth and sixth attachment members, with said third fluid passageway in fluid communication with said first fluid passageway and with said fourth fluid passageway in fluid communication with said second fluid passageway, and with said fifth fluid port of said actuator in fluid communication with said first fluid distribution channel through said first fluid passageway and said third fluid passageway, and with said sixth fluid port of said actuator in fluid communication with said second fluid distribution channel through said second fluid passageway and said fourth fluid passageway.

4. The tool actuator of claim 1 wherein said body is said rotatable member and said shaft is said stationary member, and said body is rigidly attached to said support frame, further including:

first and second fluid passageways with said first fluid passageway in fluid communication with said first fluid distribution channel and with said second fluid passageway in fluid communication with said second fluid distribution channel;

a fifth attachment member attached to said first shaft end portion and extending laterally outward beyond said body and rigidly attached to said attachment bracket;

a sixth attachment member attached to said second shaft end portion and extending laterally outward beyond said body and rigidly attached to said attachment bracket; and third and fourth fluid passageways, each located interior of one or the other of said fifth and sixth attachment members, with said third fluid passageway in fluid communication with said first fluid passageway and with said fourth fluid passageway in fluid communication with said second fluid passageway, and with said first fluid port in fluid communication with said first fluid distribution channel through said first fluid passageway and said third fluid passageway, and with said second fluid port in fluid communication with said second fluid distribution channel through said second fluid passageway and said fourth fluid passageway.

5. The tool actuator of claim 1 wherein at least said first and third wall portions are positioned toward said first body end.

6. The tool actuator of claim 1 wherein said first and third wall portions are positioned toward said first body end, and said second and fourth wall portions are positioned toward said first body end.

7. The tool actuator of claim 1 wherein said first and third wall portions are positioned toward said first body end, and said second and fourth wall portions are positioned spaced apart therefrom toward said second body end.

8. The tool actuator of claim 1 wherein said first and second wall portions comprise portions of said body, and said third and fourth wall portions comprise portions of said shaft.

9. The tool actuator of claim 1 wherein said first and second wall portions comprise portions of said body.

10. The tool actuator of claim 1 wherein said third and fourth wall portions comprise portions of said shaft.

11. The tool actuator of claim 1 wherein said third and fourth wall portions are removably attached to said shaft.

12. The tool actuator of claim 1 wherein said first and second wall portions are removably attached to said body.

13. The tool actuator of claim 1 wherein said shaft includes a main portion and said third and fourth wall portions comprise portions of a shaft flange removably attached to said main portion of said shaft.

14. The tool actuator of claim 1 wherein at least one of said third and fourth wall portions is removably attached to said shaft.

15. A fluid-powered tool actuator connectable to a source of pressurized fluid remote from the tool actuator and usable with a vehicle having an arm and a rotation link associated therewith for rotation of the tool actuator in a first plane defined by movement of the rotation link relative to the arm, each of the arm and rotation link having an attachment member located toward a free end thereof, and usable with a tool having a first tool attachment member and a second tool attachment member spaced away from the first tool attachment member, the tool actuator comprising:

a body having a longitudinal axis and first and second body ends, said body having first, second, third and fourth fluid ports for operation of the tool actuator in response to the selective application of pressurized fluid thereto from the source of pressurized fluid;

an attachment bracket attached to said body and having a first attachment member located generally along said body axis for pivotal attachment to the vehicle arm by the arm attachment member and a second attachment member located generally along said body axis away from said first attachment member for pivotal attachment to the rotation link by the rotation link attachment member, said first and second attachment members being selectively detachable from the arm and rotation link attachment members, wherein with said first and second attachment members attached to the arm and rotation link attachment members, movement of the rotation link causes said body to rotate about the vehicle arm with movement of said longitudinal axis of said body in generally parallel alignment with the first plane, and wherein the tool actuator is selectively detachable from the vehicle arm and rotation link;

a shaft rotatably disposed within said body in general coaxial arrangement with said body;

first and second wall portions movable with said body;

third and fourth wall portions movable with said shaft, said first and third wall portions having a first circumferentially extending fluid distribution channel located therebetween, and said second and fourth wall portions having a second circumferentially extending fluid distribution channel located therebetween, with said first fluid distribution channel in fluid communication with said first fluid port and remaining in fluid communication therewith as said shaft rotates and said second fluid distribution channel in fluid communication with said second fluid port and remaining in fluid communication therewith as said shaft rotates;

first and second fluid passageways with said first fluid passageway in fluid communication with said first fluid distribution channel and with said second fluid passageway in fluid communication with said second fluid distribution channel;

a linear-to-rotary torque transmitting member mounted for longitudinal movement within said body in response to selective application of pressurized fluid to said third fluid port and said fourth fluid port from the source of pressurized fluid, said torque-transmitting member engaging said body and said shaft to translate longitudinal movement of said torque-transmitting member into clockwise and counterclockwise rotational movement of said shaft relative to said body;

a third attachment member attached to said first shaft end portion for movement therewith and extending laterally outward, a fourth attachment member attached to said second shaft end portion for movement therewith and extending laterally outward;

third and fourth fluid passageways, each located interior of one or the other of said third and fourth attachment members, with said third fluid passageway in fluid communication with said first fluid passageway and with said fourth fluid passageway in fluid communication with said second fluid passageway;

a support frame attached to said third and fourth attachment members and positioned laterally outward beyond said body;

a fifth attachment member attached to said support frame and located for releasable attachment to the first tool attachment member;

a sixth attachment member movably attached to said support frame for movement relative to said fifth attachment member for releasable attachment to the second tool attachment member, said fifth and sixth attachment members being attachable to the tool for rotation of the tool with said shaft through a second plane extending laterally, generally transverse to the first plane; and an actuator attached to said support frame, said actuator having a fifth fluid port in fluid communication with said third fluid passageway and a sixth fluid port in fluid communication with said fourth fluid passageway for operation of said actuator in response to the selective application of pressurized fluid to said first and second fluid ports of said body from the source of pressurized fluid, said actuator having a member attached to said sixth attachment member for selectively moving said sixth attachment member in response to the selective application of pressurized fluid to said first and second fluid ports to permit connection and disconnection of said fifth and sixth attachment members to and from the first and second tool attachment members, whereby the tool attached to the tool actuator is rotatable in the first plane and laterally tiltable in the second plane in response to rotation of said shaft.

16. The tool actuator of claim 15 wherein said actuator is a linear actuator and said member is an extendable member.

17. A fluid-powered tool actuator connectable to a source of pressurized fluid remote from the tool actuator and usable with a vehicle having an arm and a rotation link associated therewith for rotation of the tool actuator in a first plane defined by movement of the rotation link relative to the arm, each of the arm and rotation link having an attachment member located toward a free end thereof, and usable with a tool having a first tool attachment member and a second tool attachment member spaced away from the first tool attachment member, the tool actuator comprising:

a body having a longitudinal axis and first and second body ends;

a first wall portion movable with said body;

a shaft rotatably disposed within said body in general coaxial arrangement with said body for rotation of said shaft and said body relative to each other with one of said shaft and said body being a stationary member and the other of said shaft and said body being a rotatable member;

a second wall portion movable with said shaft, said first wall portion and said second wall portion having a circumferentially extending fluid distribution channel located therebetween;

first, second and third fluid ports for operation of the tool actuator in response to the selective application of pressurized fluid thereto from the source of pressurized fluid, said third fluid port in fluid communication with said fluid distribution channel and remaining in fluid communication therewith as said rotatable member rotates relative to said stationary member;

a linear-to-rotary torque transmitting member mounted for longitudinal movement within said body in response to selective application of pressurized fluid to said first fluid port and said second fluid port from the source of pressurized fluid, said torque-transmitting member engaging said body and said shaft to translate longitudinal movement of said torque-transmitting member into clockwise and counterclockwise relative rotational movement of said shaft and said body;

an attachment bracket attached to said stationary member and having a first attachment member located generally along said body axis for pivotal attachment to the vehicle arm by the arm attachment member and a second attachment member located generally along said body axis away from said first attachment member for pivotal attachment to the rotation link by the rotation link attachment member, said first and second attachment members being selectively detachable from the arm and rotation link attachment members, wherein with said first and second attachment members attached to the arm and rotation link attachment members, movement of the rotation link causes said stationary member to rotate about the vehicle arm with movement of said longitudinal axis of said body in generally parallel alignment with the first plane, and wherein the tool actuator is selectively detachable from the vehicle arm and rotation link;

a support frame attached to said rotatable member and positioned laterally outward beyond said body;

a third attachment member attached to said support frame and located for releasable attachment to the first tool attachment member;

a fourth attachment member movably attached to said support frame for movement relative to said third attachment member for releasable attachment to the second tool attachment member, said third and fourth attachment members being attachable to the tool for rotation of the tool with said rotatable member through a second plane extending laterally, generally transverse to the first plane; and an actuator attached to said support frame, said actuator having a fourth fluid port in fluid communication with said fluid distribution channel for operation of said actuator in at least one direction in response to the selective application of pressurized fluid to said third fluid port from the source of pressurized fluid, said actuator having a member attached to said fourth attachment member for selectively moving said fourth attachment member in response to the selective application of pressurized fluid to said third fluid port to permit at least one of connection and disconnection of said third and fourth attachment members to and from the first and second tool attachment members, whereby the tool attached to the tool actuator is rotatable in the first plane and laterally tiltable in the second plane in response to rotation of said rotatable member.

18. The tool actuator of claim 17 wherein said actuator is a linear actuator and said member is an extendable member.

19. The tool actuator of claim 17 wherein at least said first and second wall portions are positioned toward said first body end.

20. The tool actuator of claim 17 wherein said first wall portion comprises a portion of said body, and said second wall portion comprises a portion of said shaft.

21. The tool actuator of claim 17 wherein said first wall portion comprises a portion of said body.

22. The tool actuator of claim 17 wherein said second wall portion comprises a portion of said shaft.

23. The tool actuator of claim 17 wherein said second wall portion is removably attached to said shaft.

24. The tool actuator of claim 17 wherein said shaft includes a main portion and said second wall portion comprises a portion of a shaft flange removably attached to said main portion of said shaft.

25. The tool actuator of claim 17 wherein said first wall portion is removably attached to said body.

26. A fluid-powered tool actuator connectable to a source of pressurized fluid remote from the tool actuator and usable with a vehicle having an arm and a rotation link associated therewith for rotation of the tool actuator in a first plane defined by movement of the rotation link relative to the arm, each of the arm and rotation link having an attachment member located toward a free end thereof, and usable with a tool having a first tool attachment member and a second tool attachment member spaced away from the first tool attachment member, the tool actuator comprising:

a body having a longitudinal axis and first and second body ends;

a first wall portion movable with said body;

a shaft rotatably disposed within said body in general coaxial arrangement with said body for rotation of said shaft and said body relative to each other with one of said shaft and said body being a stationary member and the other of said shaft and said body being a rotatable member;

a second wall portion movable with said shaft, said first wall portion and said second wall portion having a first circumferentially extending fluid distribution channel located therebetween;

at least first, second and third fluid ports for operation of the tool actuator in response to the selective application of pressurized fluid thereto from the source of pressurized fluid, said third fluid port in fluid communication with said first fluid distribution channel and remaining in fluid communication therewith as said rotatable member rotates relative to said stationary member;

a linear-to-rotary torque transmitting member mounted for longitudinal movement within said body in response to selective application of pressurized fluid to said first fluid port and said second fluid port from the source of pressurized fluid, said torque-transmitting member engaging said body and said shaft to translate longitudinal movement of said torque-transmitting member into clockwise and counterclockwise relative rotational movement of said shaft and said body;

an attachment bracket attached to said stationary member and having a first attachment member located generally along said body axis for pivotal attachment to the vehicle arm by the arm attachment member and a second attachment member located generally along said body axis away from said first attachment member for pivotal attachment to the rotation link by the rotation link attachment member, said first and second attachment members being selectively detachable from the arm and rotation link attachment members, wherein with said first and second attachment members attached to the arm and rotation link attachment members, movement of the rotation link causes said stationary member to rotate about the vehicle arm with movement of said longitudinal axis of said body in generally parallel alignment with the first plane, and wherein the tool actuator is selectively detachable from the vehicle arm and rotation link;

a support frame attached to said rotatable member and positioned laterally outward beyond said body;

a third attachment member attached to said support frame and located for releasable attachment to the first tool attachment member;

a fourth attachment member movably attached to said support frame for movement relative to said third attachment member for releasable attachment to the second tool attachment member, said third and fourth attachment members being attachable to the tool for rotation of the tool with said rotatable member through a second plane extending laterally, generally transverse to the first plane;

an actuator attached to said support frame, said actuator having at least a fourth fluid port in fluid communication with said first fluid distribution channel for operation of said actuator in response to the selective application of pressurized fluid to said third fluid port from the source of pressurized fluid, said actuator having a member attached to said fourth attachment member for selectively moving said fourth attachment member in response to the selective application of pressurized fluid to said third fluid port to permit at least one of connection and disconnection of said third and fourth attachment members to and from the first and second tool attachment members, whereby the tool attached to the tool actuator is rotatable in the first plane and laterally tiltable in the second plane in response to rotation of said rotatable member;

at least a first fluid passageway interior of said second wall portion in fluid communication with said first fluid distribution channel;

a fifth attachment member attached to said first shaft end portion;

a sixth attachment member attached to said second shaft end portion, at least one of said fifth attachment member and said sixth attachment member being configured for movement with said shaft and extending laterally outward beyond said body and attached to said support frame; and at least a second fluid passageway located interior of one of said fifth and sixth attachment members, with said second fluid passageway in fluid communication with said first fluid passageway, and with said fourth fluid port of said actuator in fluid communication with said first fluid distribution channel through said first fluid passageway and said second fluid passageway.

27. The tool actuator of claim 26 wherein said actuator is a linear actuator and said member is an extendable member.

28. A fluid-powered tool actuator connectable to a source of pressurized fluid remote from the tool actuator and usable with a vehicle having an arm and a rotation link associated therewith for rotation of the tool actuator in a first plane defined by movement of the rotation link relative to the arm, each of the arm and rotation link having an attachment member located toward a free end thereof, and usable with a tool having a first tool attachment member and a second tool attachment member spaced away from the first tool attachment member, the tool actuator comprising:

a body having a longitudinal axis and first and second body ends, said body having first, second and third fluid ports for operation of the tool actuator in response to the selective application of pressurized fluid thereto from the source of pressurized fluid;

a first wall portion movable with said body;

an attachment bracket attached to said body and having a first attachment member located generally along said body axis for pivotal attachment to the vehicle arm by the arm attachment member and a second attachment member located generally along said body axis away from said first attachment member for pivotal attachment to the rotation link by the rotation link attachment member, said first and second attachment members being selectively detachable from the arm and rotation link attachment members, wherein with said first and second attachment members attached to the arm and rotation link attachment members, movement of the rotation link causes said body to rotate about the vehicle arm with movement of said longitudinal axis of said body in generally parallel alignment with the first plane, and wherein the tool actuator is selectively detachable from the vehicle arm and rotation link;

a shaft rotatably disposed within said body in general coaxial arrangement with said body;

a second wall portion movable with said shaft, said first wall portion and said second wall portion having a circumferentially extending fluid distribution channel located therebetween, with said fluid distribution channel in fluid communication with said first fluid port and remaining in fluid communication therewith as said shaft rotates;

a first fluid passageway interior of said second wall portion with said first fluid passageway in fluid communication with said fluid distribution channel;

a linear-to-rotary torque transmitting member mounted for longitudinal movement within said body in response to selective application of pressurized fluid to said second fluid port and said third fluid port from the source of pressurized fluid, said torque-transmitting member engaging said body and said shaft to translate longitudinal movement of said torque-transmitting member into clockwise and counterclockwise rotational movement of said shaft relative to said body;

a third attachment member attached to said first shaft end portion for movement therewith and extending laterally outward beyond said body;

a fourth attachment member attached to said second shaft end portion for movement therewith and extending laterally outward beyond said body;

a second fluid passageway interior of one of said third attachment member and said fourth attachment member, with said second fluid passageway in fluid communication with said first fluid passageway;

a support frame attached to said third and fourth attachment members and positioned laterally outward beyond said body;

a fifth attachment member attached to said support frame and located for releasable attachment to the first tool attachment member;

a sixth attachment member movably attached to said support frame for movement relative to said fifth attachment member for releasable attachment to the second tool attachment member, said fifth and sixth attachment members being attachable to the tool for rotation of the tool with said shaft through a second plane extending laterally, generally transverse to the first plane; and an actuator attached to said support frame, said actuator having a fourth fluid port in fluid communication with said second fluid passageway for operation of said actuator in at least one direction in response to the selective application of pressurized fluid to said first fluid port of said body from the source of pressurized fluid, said actuator having a member attached to said sixth attachment member for selectively moving said sixth attachment member in response to the selective application of pressurized fluid to said first fluid port to permit one of connection and disconnection of said fifth and sixth attachment members to and from the first and second tool attachment members, whereby the tool attached to the tool actuator is rotatable in the first plane and laterally tiltable in the second plane in response to rotation of said shaft.

29. The tool actuator of claim 28 wherein said actuator is a linear actuator and said member is an extendable member.

30. A fluid-powered tool actuator connectable to a source of pressurized fluid remote from the tool actuator and usable with a vehicle having an arm and a rotation link associated therewith for rotation of the tool actuator in a first plane defined by movement of the rotation link relative to the arm, each of the arm and rotation link having an attachment member located toward a free end thereof, and usable with a tool having a first tool attachment member and a second tool attachment member spaced away from the first tool attachment member, the tool actuator comprising:

a body having a longitudinal axis and first and second body ends;

a first wall portion movable with said body;

a shaft rotatably disposed within said body in general coaxial arrangement with said body for rotation of said shaft and said body relative to each other with one of said shaft and said body being a stationary member and the other of said shaft and said body being a rotatable member;

a second wall portion movable with said shaft, said first wall portion and said second wall portion having at least a first circumferentially extending fluid distribution channel located therebetween;

at least first, second and third fluid ports for operation of the tool actuator in response to the selective application of pressurized fluid thereto from the source of pressurized fluid, said third fluid port in fluid communication with said first fluid distribution channel and remaining in fluid communication therewith as said rotatable member rotates relative to said stationary member;

a linear-to-rotary torque transmitting member mounted for longitudinal movement within said body in response to selective application of pressurized fluid to said first fluid port and said second fluid port from the source of pressurized fluid, said torque-transmitting member engaging said body and said shaft to translate longitudinal movement of said torque-transmitting member into clockwise and counterclockwise relative rotational movement of said shaft and said body;

an attachment bracket attached to said stationary member and having a first attachment member located generally along said body axis for pivotal attachment to the vehicle arm by the arm attachment member and a second attachment member located generally along said body axis away from said first attachment member for pivotal attachment to the rotation link by the rotation link attachment member, said first and second attachment members being selectively detachable from the arm and rotation link attachment members, wherein with said first and second attachment members attached to the arm and rotation link attachment members, movement of the rotation link causes said stationary member to rotate about the vehicle arm with movement of said longitudinal axis of said body in generally parallel alignment with the first plane, and wherein the tool actuator is selectively detachable from the vehicle arm and rotation link;

a support frame attached to said rotatable member and positioned laterally outward beyond said body;

a third attachment member attached to said support frame and located for releasable attachment to the first tool attachment member;

a fourth attachment member movably attached to said support frame for movement relative to said third attachment member for releasable attachment to the second tool attachment member, said third and fourth attachment members being attachable to the tool for rotation of the tool with said rotatable member through a second plane extending laterally, generally transverse to the first plane;

an actuator attached to said support frame, said actuator having at least a fourth fluid port in fluid communication with said first fluid distribution channel for operation of said actuator in response to the selective application of pressurized fluid to said third fluid port from the source of pressurized fluid, said actuator having a member attached to said fourth attachment member for selectively moving said fourth attachment member in response to the selective application of pressurized fluid to said third fluid port to permit at least one of connection and disconnection of said third and fourth attachment members to and from the first and second tool attachment members, whereby the tool attached to the tool actuator is rotatable in the first plane and laterally tiltable in the second plane in response to rotation of said rotatable member;

at least a first fluid passageway interior of said second wall portion with said first fluid passageway in fluid communication with said first fluid distribution channel;

a fifth attachment member attached to said shaft toward one of said first and second body ends, said fifth attachment member having at least a second fluid passageway interior thereof with said second fluid passageway in fluid communication with said first fluid passageway, when said rotatable member is said shaft and said stationary member is said body, said third fluid port being in fluid communication with said fourth fluid port of said actuator via said third fluid port being in fluid communication with said first fluid distribution channel, said first fluid distribution channel being in fluid communication with said first fluid passageway, said first fluid passageway being in fluid communication with said second fluid passageway and said second fluid passageway being in fluid communication with said fourth fluid port, and when said rotatable member is said body and said stationary member is said shaft, said third fluid port being in fluid communication with said fourth fluid port of said actuator via said third fluid port being in fluid communication with said second fluid passageway, said second fluid passageway being in fluid communication with said first fluid passageway, said first fluid passageway being in fluid communication with said first fluid distribution channel and said first fluid distribution channel being in fluid communication with said fourth fluid port, and when said rotatable member is said shaft and said stationary member is said body, said fifth attachment member being attached to said support frame for rotation of said support frame with said shaft and when said rotatable member is said body and said stationary member is said shaft, said fifth attachment member being attached to said attachment bracket; and a sixth attachment member attached to said shaft toward the other of said first and second body ends, when said rotatable member is said shaft and said stationary member is said body, said sixth attachment member being attached to said support frame for rotation of said support frame with said shaft and when said rotatable member is said body and said stationary member is said shaft, said sixth attachment member being attached to said attachment bracket.

31. The tool actuator of claim 30 wherein said actuator is a linear actuator and said member is an extendable member.

32. The tool actuator of claim 30, further including:

a third wall portion movable with said body;

a fourth wall portion movable with said shaft, said third wall portion and said fourth wall portion having a second circumferentially extending fluid distribution channel located therebetween;

a fifth fluid port for operation of the tool actuator in response to the selective application of pressurized fluid thereto from the source of pressurized fluid, said fifth fluid port in fluid communication with said second fluid distribution channel and remaining in fluid communication therewith as said rotatable member rotates relative to said stationary member;

said actuator having a sixth fluid port in fluid communication with said second fluid distribution channel for operation of said actuator in response to the selective application of pressurized fluid to said fifth fluid port from the source of pressurized fluid, said member of said actuator selectively moving said fourth attachment member in response to the selective application of pressurized fluid to said fifth fluid port to permit the other of connection and disconnection of said third and fourth attachment members to and from the first and second tool attachment members;

at least a third fluid passageway interior of said fourth wall portion with said third fluid passageway in fluid communication with said second fluid distribution channel; and one of said fifth and sixth attachment members having a fourth fluid passageway interior thereof with said fourth fluid passageway in fluid communication with said third fluid passageway, when said rotatable member is said shaft and said stationary member is said body, said fifth fluid port being in fluid communication with said sixth fluid port of said actuator via said fifth fluid port being in fluid communication with said second fluid distribution channel, said second fluid distribution channel being in fluid communication with said third fluid passageway, said third fluid passageway being in fluid communication with said fourth fluid passageway and said fourth fluid passageway being in fluid communication with said sixth fluid port, and when said rotatable member is said body and said stationary member is said shaft, said fifth fluid port being in fluid communication with said sixth fluid port of said actuator via said fifth fluid port being in fluid communication with said fourth fluid passageway, said fourth fluid passageway being in fluid communication with said third fluid passageway, said third fluid passageway being in fluid communication with said second fluid distribution channel and said second fluid distribution channel being in fluid communication with said sixth fluid port.

33. The tool actuator of claim 32 for use with the tool having at least seventh and eighth fluid ports for operation of the tool in response to the selective application of pressurized fluid thereto from the source of pressurized fluid, and wherein said shaft is said rotatable member and said body is said stationary member, further including:

ninth and tenth fluid ports;

a fifth wall portion movable with said body;

a fluid gland positioned coaxially within said fifth wall portion at one of said first and second body ends, said fluid gland and said fifth wall portion having third and fourth circumferentially extending fluid distribution channels located therebetween, with said third fluid distribution channel in fluid communication with said ninth port and remaining in fluid communication therewith as said shaft rotates and said fourth fluid distribution channel in fluid communication with said tenth port and remaining in fluid communication therewith as said shaft rotates, said fluid gland further having fifth and sixth fluid passageways interior thereof with said fifth fluid passageway in fluid communication with said third fluid distribution channel and said sixth fluid passageway in fluid communication with said fourth fluid distribution channel; and seventh and eighth fluid passageways interior of one of said fifth and sixth attachment members with said seventh fluid passageway in fluid communication with said fifth fluid passageway in said fluid gland and said eighth fluid passageway in fluid communication with said sixth fluid passageway in said fluid gland, and with said seventh fluid passageway in fluid communication with said seventh fluid port of the tool and said eighth fluid passageway in fluid communication with said eighth fluid port of the tool.

34. The tool actuator of claim 30 wherein said shaft has a fluid gland portion positioned coaxial within said body, and said second wall portion comprises a portion of said fluid gland portion of said shaft.

* * * * *